US009728877B1

(12) United States Patent
Nakamura

(10) Patent No.: US 9,728,877 B1
(45) Date of Patent: Aug. 8, 2017

(54) CONNECTOR AND CABLE HARNESS

(71) Applicant: JAPAN AVIATION ELECTRONICS INDUSTRY, LIMITED, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/475,703

(22) Filed: Mar. 31, 2017

(30) Foreign Application Priority Data

Jun. 22, 2016 (JP) ..... 2016-123892

(51) Int. Cl.
*H01R 4/24* (2006.01)
*H01R 12/79* (2011.01)

(52) U.S. Cl.
CPC ..... *H01R 12/79* (2013.01)

(58) Field of Classification Search
CPC ..... H01R 12/59; H01R 12/77; H01R 12/771
USPC ..... 439/492, 495, 499
See application file for complete search history.

(56) References Cited

U.S. PATENT DOCUMENTS 3,573,719 A * 4/1971 Lightner ..... H01R 12/777 439/494
5,213,534 A 5/1993 Gardner et al.
8,858,254 B2 * 10/2014 Ikari ..... H01R 12/592 439/492

FOREIGN PATENT DOCUMENTS

| | | | |
|---|---|---|---|
| JP | H07-296912 | A | 11/1995 |
| JP | 2002-158055 | A | 5/2002 |
| JP | 2004-288648 | A | 10/2004 |
| JP | 2010-238512 | A | 10/2010 |
| JP | 2015-188000 | A | 10/2015 |
| JP | 5909586 | B1 | 4/2016 |

* cited by examiner

*Primary Examiner* — Phuong Dinh
(74) *Attorney, Agent, or Firm* — Collard & Roe, P.C.

(57) ABSTRACT

A connector is attachable to a first connection object in an up-down direction and is connectable with a second connection object which is to be inserted rearward into the connector along a front-rear direction perpendicular to the up-down direction. The connector comprises a plurality of terminals and a holding member. The holding member has a holding portion and a sandwiched portion. Each of the terminals has a connecting portion and a contact portion. The sandwiched portion and the connecting portion at least overlap with each other when the connector is viewed along the up-down direction. One of the sandwiched portion and the connecting portion is visible when the connector is viewed along an upward direction of the up-down direction. A remaining one of the sandwiched portion and the connecting portion is visible when the connector is viewed along a downward direction of the up-down direction.

11 Claims, 16 Drawing Sheets

CONNECTOR AND CABLE HARNESS

CROSS REFERENCE TO RELATED APPLICATIONS

This application is based on and claims priority under 35 U.S.C. §119 to Japanese Patent Application No. JP2016-123892 filed Jun. 22, 2016, the contents of which are incorporated herein in their entirety by reference.

BACKGROUND OF THE INVENTION

This invention relates to a connector connectable with a plate-like or sheet-like object such as an FPC (Flexible Printed Circuit) or an FFC (Flexible Flat Cable), and to a cable harness comprising the connector.

Referring to FIGS. 31 and 32, JP-A 2015-188000 (Patent Document 1) discloses a connector 900. The connector 900 is attachable to a circuit board (not shown) in a Z-direction and is connectable with a flexible printed circuit 950 which is to be inserted therein toward a negative X-direction along an X-direction. The flexible printed circuit 950 has connection portions 960. The connector 900 comprises a holding member 910, a receiving portion 915 and a plurality of terminals 920. The receiving portion 915 receives a part of the flexible printed circuit 950 when the flexible printed circuit 950 is inserted into the connector 900. Each of the terminals 920 has a lower-jaw portion 922, an upper-jaw portion 924, an intermediate portion 926 and a fixed portion 928. The upper-jaw portion 924 has a contact portion 925. The contact portion 925 is connected with the connection portion 960 of the flexible printed circuit 950 when the flexible printed circuit 950 is inserted into the connector 900. The intermediate portion 926 connects the lower-jaw portion 922 and the upper-jaw portion 924 with each other. The fixed portion 928 is soldered on a wired pattern (not shown) of a circuit board (not shown) when the connector 900 is mounted on the circuit board (not shown).

The connector 900 of Patent Document 1 is configured to be mounted on a solid circuit board. Meanwhile, there is a need for a connector to be attached to a flexible substrate such as cables, an FPC (Flexible Printed Circuit) or an FFC (Flexible Flat Cable). If conductive cores of cables or connection portions of an FPC are subsequently soldered to terminals of a connector when the terminals of the connector are attached thereto to assemble a cable harness, an assembly process of the cable harness is complicated. In order to simplify an assembly process of a cable harness comprising a connector, it is desired that the connector has a structure which enables its terminals to be simultaneously soldered to conductive cores of cables or connection portions of an FPC by pulsed heating method.

SUMMARY OF THE INVENTION

It is therefore an object of the present invention to provide a connector which is mountable on a flexible substrate such as cables and which has a structure enabling its terminals to be simultaneously connected with cables by pulsed heating method. In addition, it is another object of the present invention to provide a cable harness comprising the connector and cables.

One aspect (first aspect) of the present invention provides a connector attachable to a first connection object in an up-down direction and connectable with a second connection object which is to be inserted rearward into the connector along a front-rear direction perpendicular to the up-down direction. The second connection object has a sheet-like or plate-like shape. The first connection object has a plurality of first connection portions. The second connection object has a plurality of second connection portions. The connector comprises a plurality of terminals and a holding member. The holding member has a holding portion and a sandwiched portion. Each of the terminals is held by the holding portion of the holding member. The terminals are arranged in a pitch direction perpendicular to both the up-down direction and the front-rear direction. Each of the terminals has a connecting portion and a contact portion. The connecting portions of the terminals are connected with the first connection portions, respectively, when the connector is attached to the first connection object. The contact portions of the terminals are connected with the second connection portions, respectively, when the second connection object is inserted into the connector. The connecting portion has a plate-like shape intersecting with the up-down direction. A center of the contact portion and a center of the connecting portion are positioned at positions different from each other in the pitch direction. The sandwiched portion and the connecting portion at least overlap with each other when the connector is viewed along the up-down direction. One of the sandwiched portion and the connecting portion is visible when the connector is viewed along an upward direction of the up-down direction. A remaining one of the sandwiched portion and the connecting portion is visible when the connector is viewed along a downward direction of the up-down direction.

Another aspect (second aspect) of the present invention provides a cable harness comprising the connector of the first aspect and cables. The cables function as the first connection object. The cables are connected with the connector.

In the connector of the present invention, the connecting portion of the terminal is formed by folding the terminal in the pitch direction from the coupling portion. Accordingly, a center of the contact portion and a center of the connecting portion are positioned at positions different from each other in the pitch direction. In addition, the sandwiched portion and the connecting portion at least overlap with each other when the connector is viewed along the up-down direction. Thus, if a conductive core (first connection portion) of a cable (first connection object) is pressed against the connecting portion by a pressing force when the conductive core (first connection portion) of the cable (first connection object) is soldered on the connecting portion, the pressing force is received by the sandwiched portion, so that the terminal itself is hardly deformed.

The connector of the present invention has the features as follows: the connecting portion has a plate-like shape intersecting with the up-down direction, one of the sandwiched portion and the connecting portion is visible when the connector is viewed along the upward direction, and a remaining one of the sandwiched portion and the connecting portion is visible when the connector is viewed along the downward direction. Accordingly, in the connector of the present invention, all of conductive cores (first connection portions) of cables (first connection object) and the connecting portions can be sandwiched between a heating tool and a support via the sandwiched portion when the conductive cores (first connection portions) of the cables (first connection object) are connected with the connecting portions, respectively. Thus, the conductive cores (first connection portions) of the cables (first connection object) can be simultaneously connected with the connecting portions, so that a manufacturing process of the cable harness can be simplified.

Figure 1:
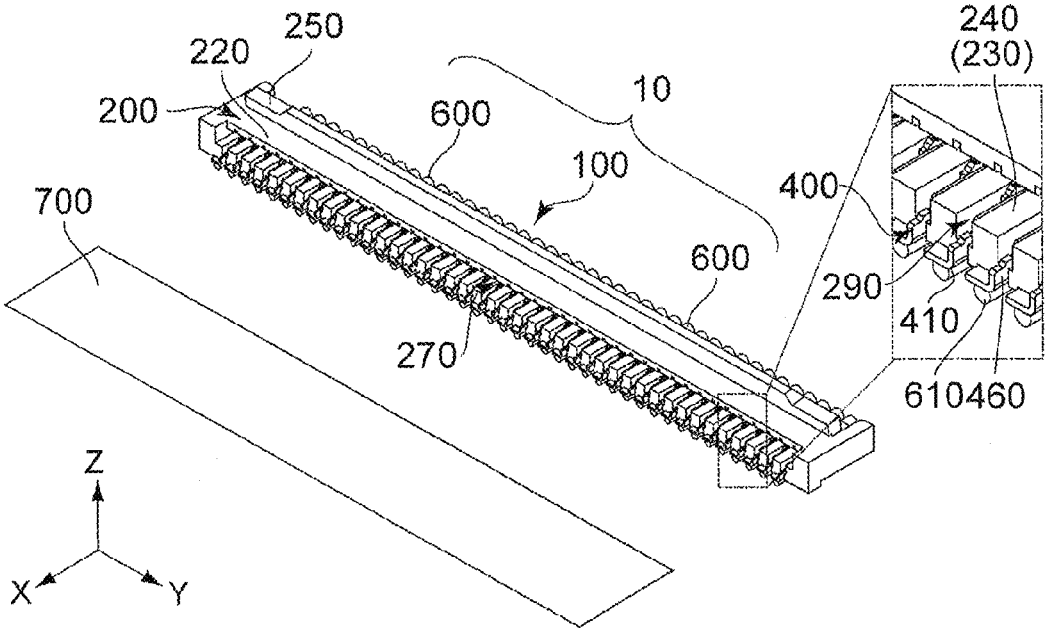
FIG. 1 is a perspective view showing a cable harness comprising cables and a connector according to a first embodiment of the present invention, wherein a part of the cable harness is illustrated enlarged.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
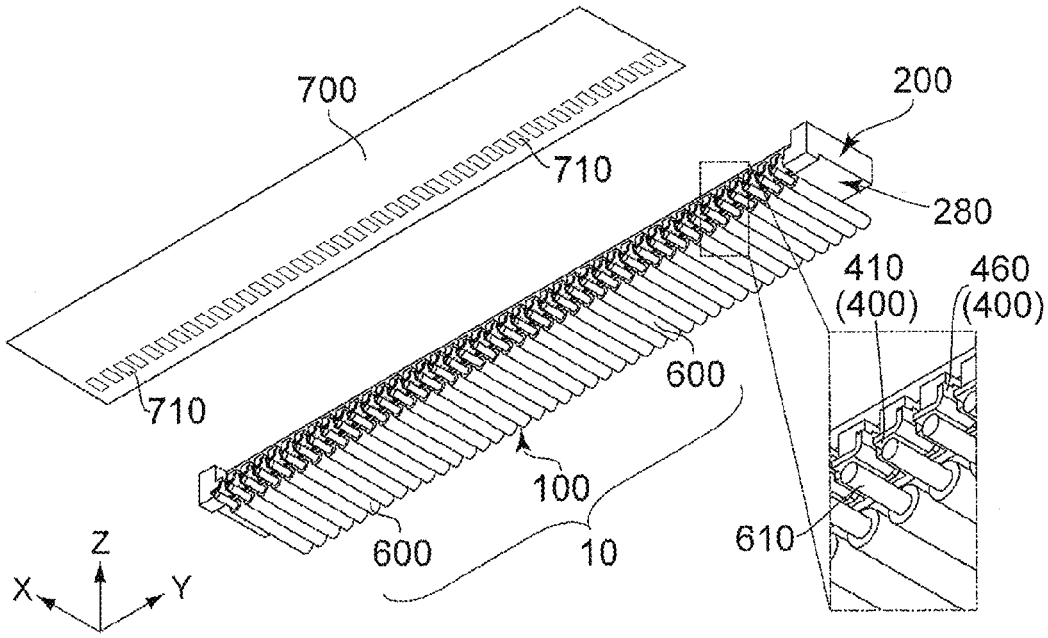
FIG. 2 is another perspective view showing the cable harness of FIG. 1, wherein a part of the cable harness is illustrated enlarged.

As shown in FIGS. 1 and 2, a cable harness 10 according to a first embodiment of the present invention comprises a connector 100 and cables 600. The cables 600 are connected as a first connection object 600 with the connector 100.

As shown in FIGS. 1 and 2, the connector 100 according to the present embodiment is attachable to the first connection object 600 such as the cables 600 in an up-down direction. In addition, the connector 100 of the present embodiment is connectable with a second connection object 700 such as an FPC (Flexible Printed Circuit) or an FFC (Flexible Flat Cable) which is to be inserted rearward into the connector 100 along a front-rear direction perpendicular to the up-down direction. In the present embodiment, the up-down direction is a Z-direction. Specifically, upward is a positive Z-direction, and downward is a negative Z-direction. In the present embodiment, the front-rear direction is an X-direction. Specifically, forward is a positive X-direction, and rearward is a negative X-direction.

As shown in FIGS. 1 and 2, the first connection object 600 consists of a plurality of the cables 600 and has a plurality of conductive cores 610, or first connection portions 610. The second connection object 700 has a sheet-like or plate-like shape and has a plurality of second connection portions 710.

As shown in FIGS. 1 and 2, the connector 100 of the present embodiment comprises a holding member 200 and a plurality of terminals 400.

Figure 6:
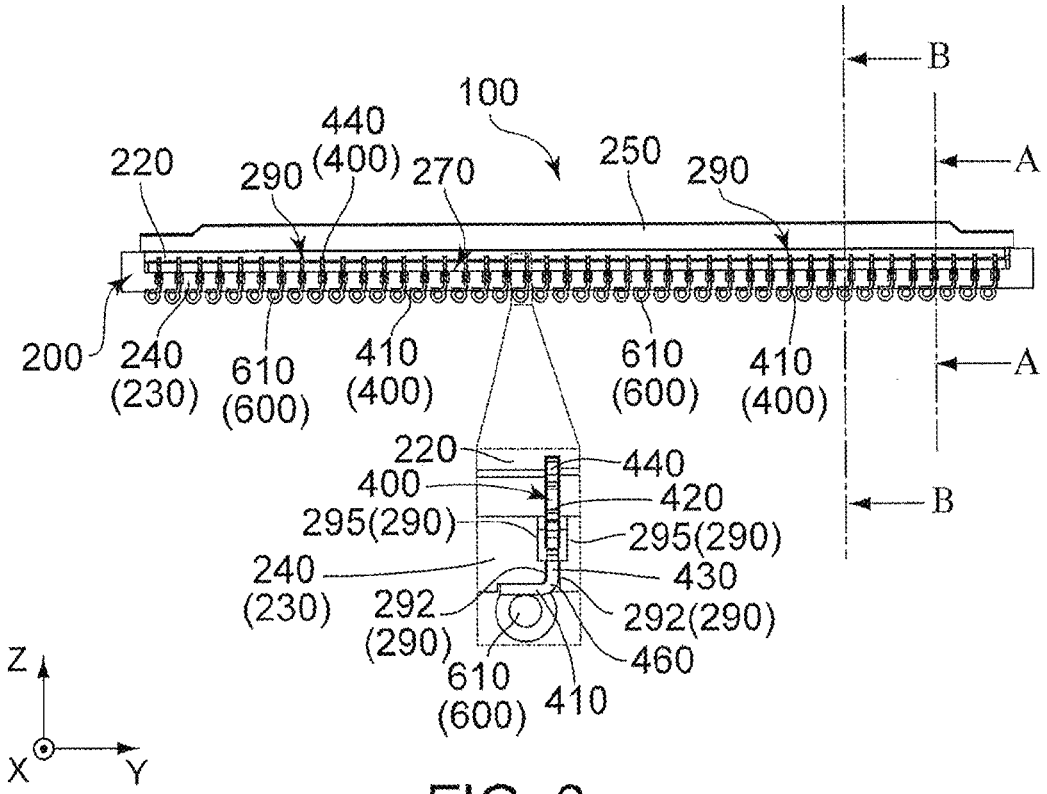
FIG. 6 is a front view showing the cable harness of FIG. 1, wherein a part of the cable harness is illustrated enlarged.
Figure 7:
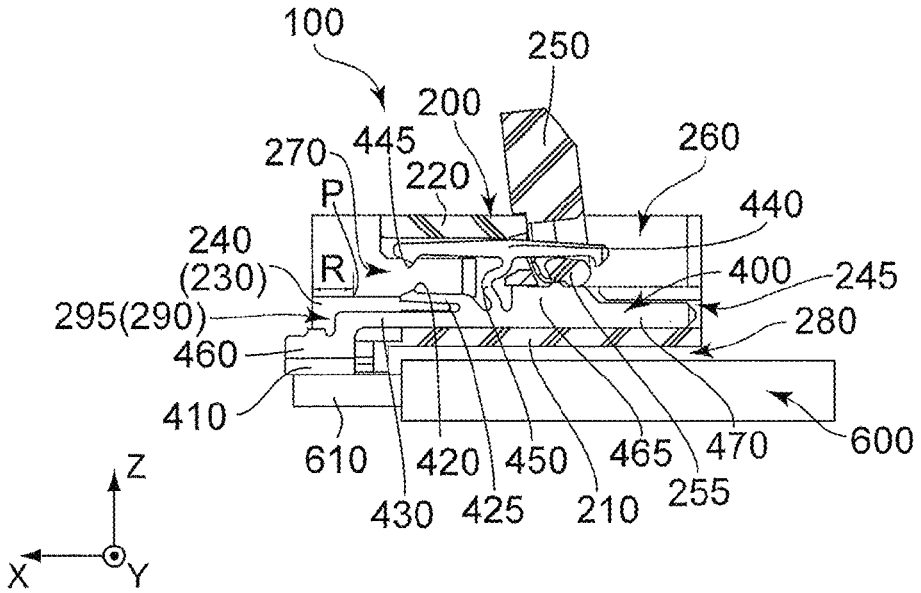
FIG. 7 is a cross-sectional view showing the cable harness of FIG. 6, taken along line A-A.
Figure 8:
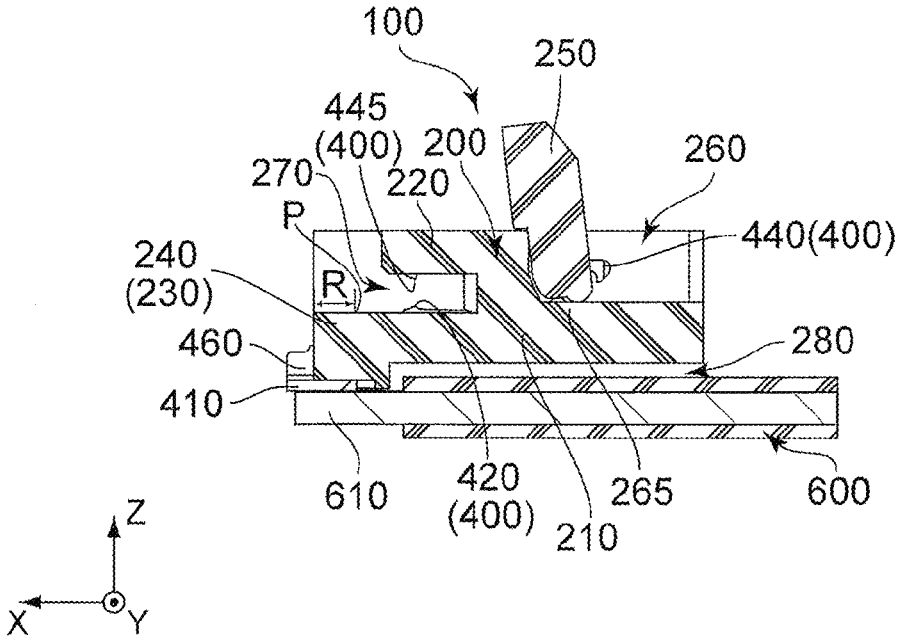
FIG. 8 is a cross-sectional view showing the cable harness of FIG. 6, taken along line B-B.
Figure 9:
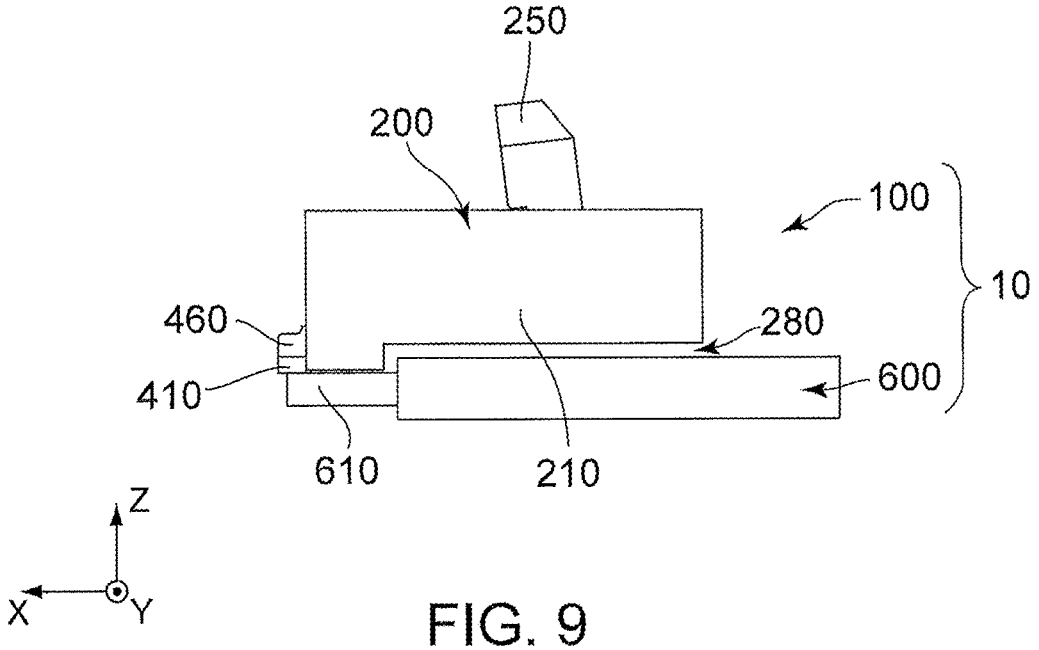
FIG. 9 is a side view showing the cable harness of FIG. 1.
Figure 10:
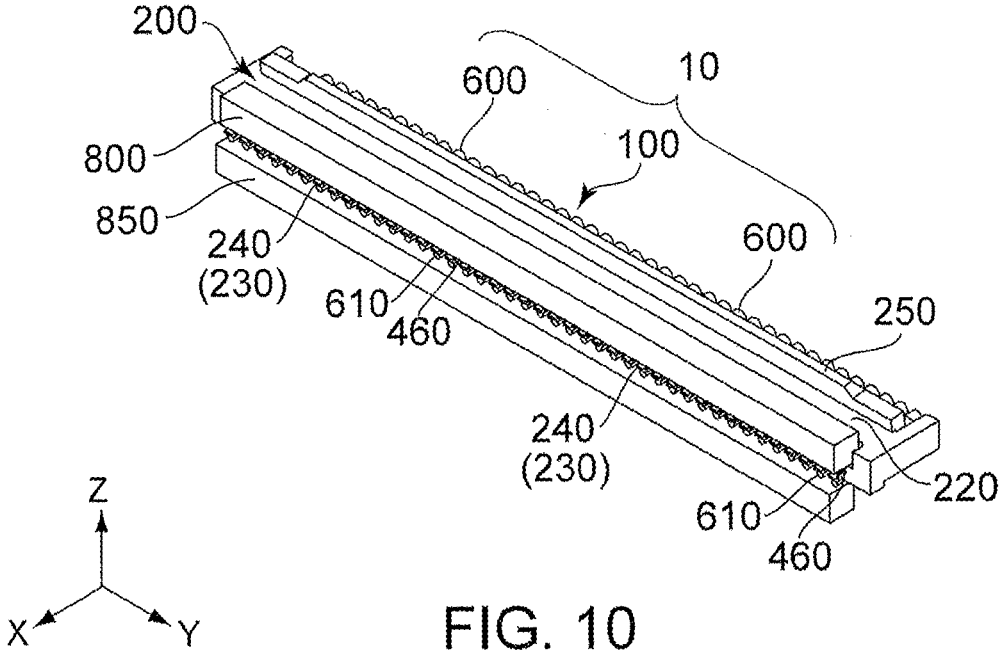
FIG. 10 is a perspective view for explaining a connecting process of the connector and the cable which are included in the cable harness of FIG. 1, wherein a sandwiched portion of the connector and conductive cores of the cables are sandwiched by a heating tool and a support.
Figure 11:
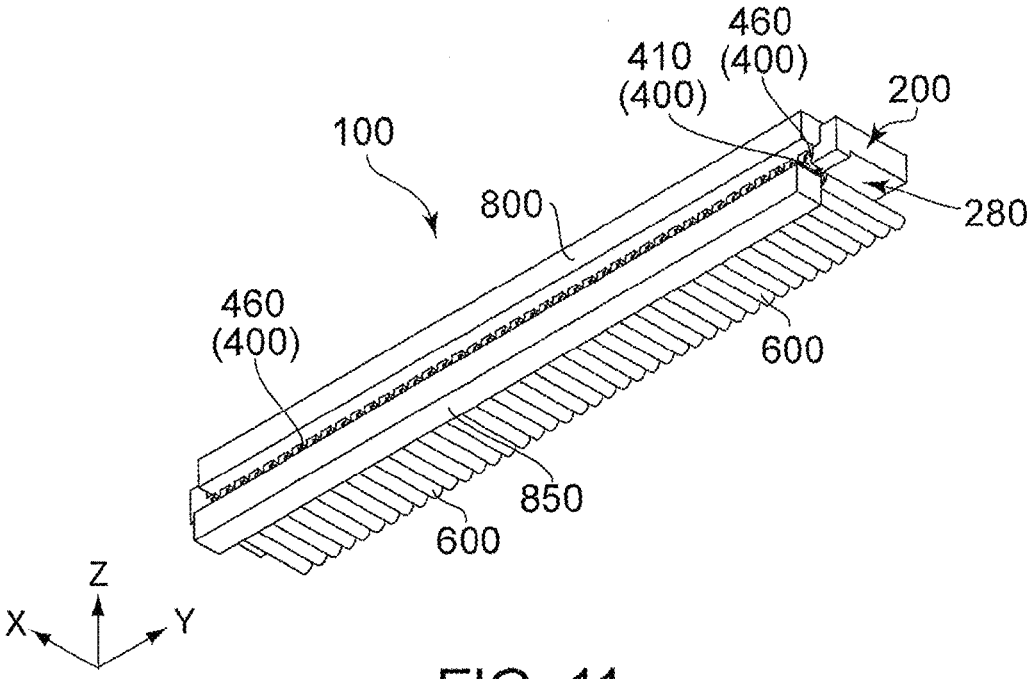
FIG. 11 is another perspective view showing the cable harness of FIG. 10.
Figure 12:
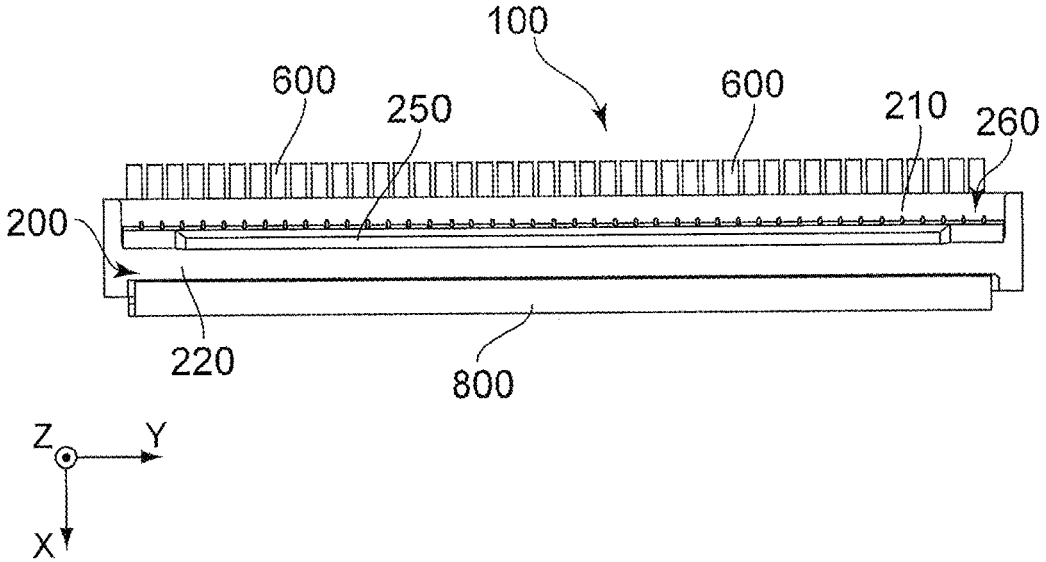
FIG. 12 is a top view showing the cable harness of FIG. 10.
Figure 13:
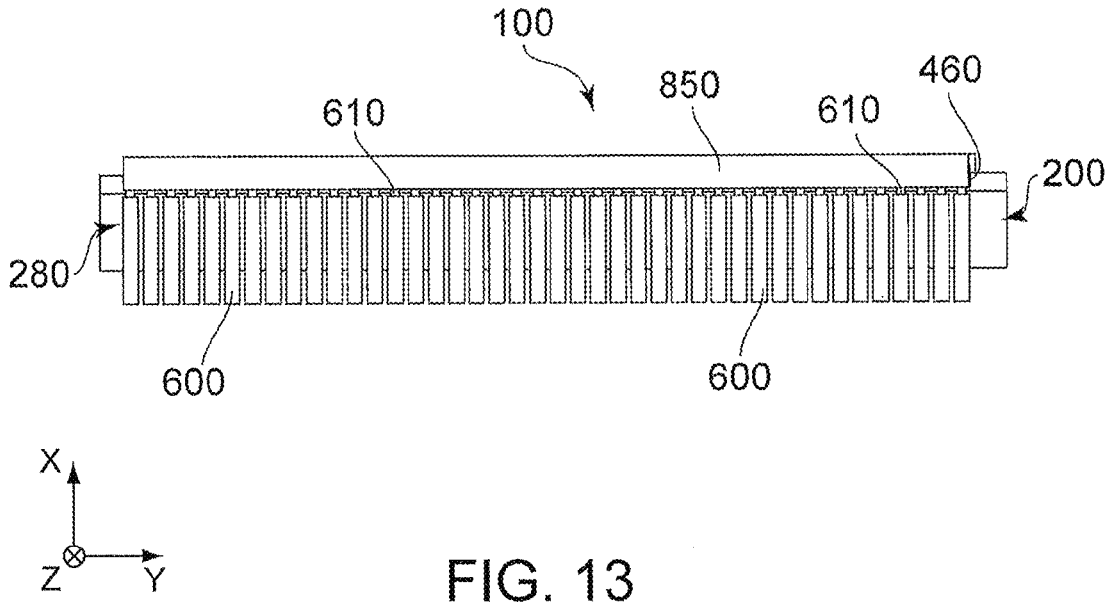
FIG. 13 is a bottom view showing the cable harness of FIG. 10.
Figure 14:
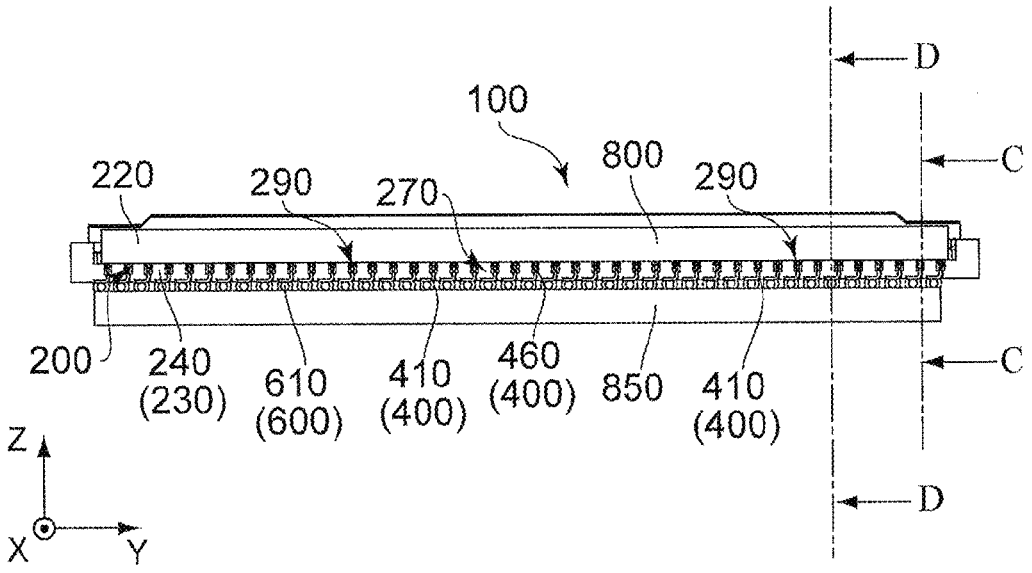
FIG. 14 is a front view showing the cable harness of FIG. 10.
Figure 15:
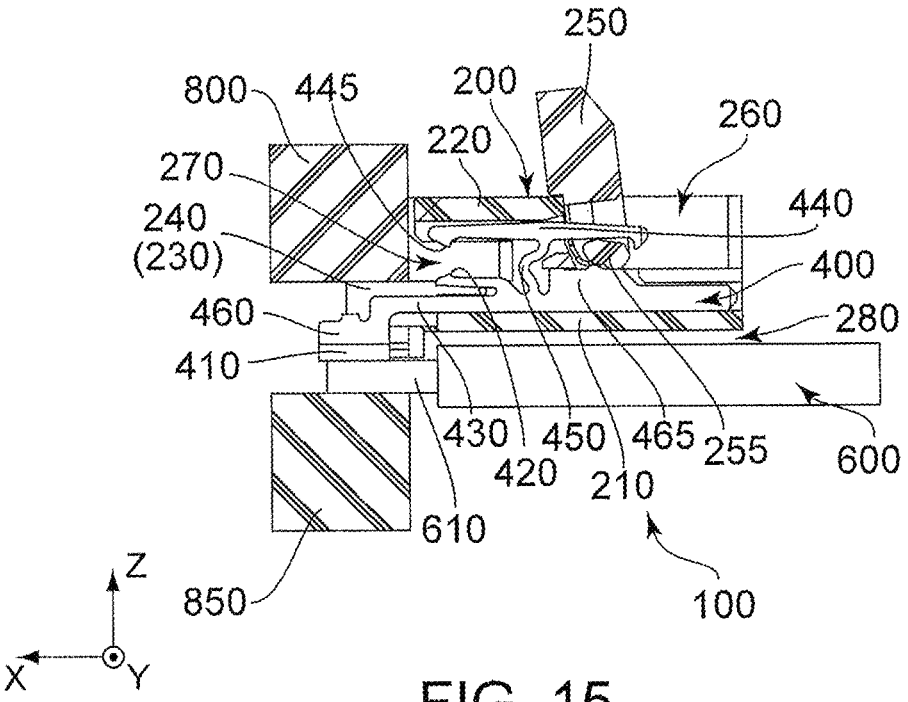
FIG. 15 is a cross-sectional view showing the cable harness of FIG. 14, taken along line C-C.
Figure 16:
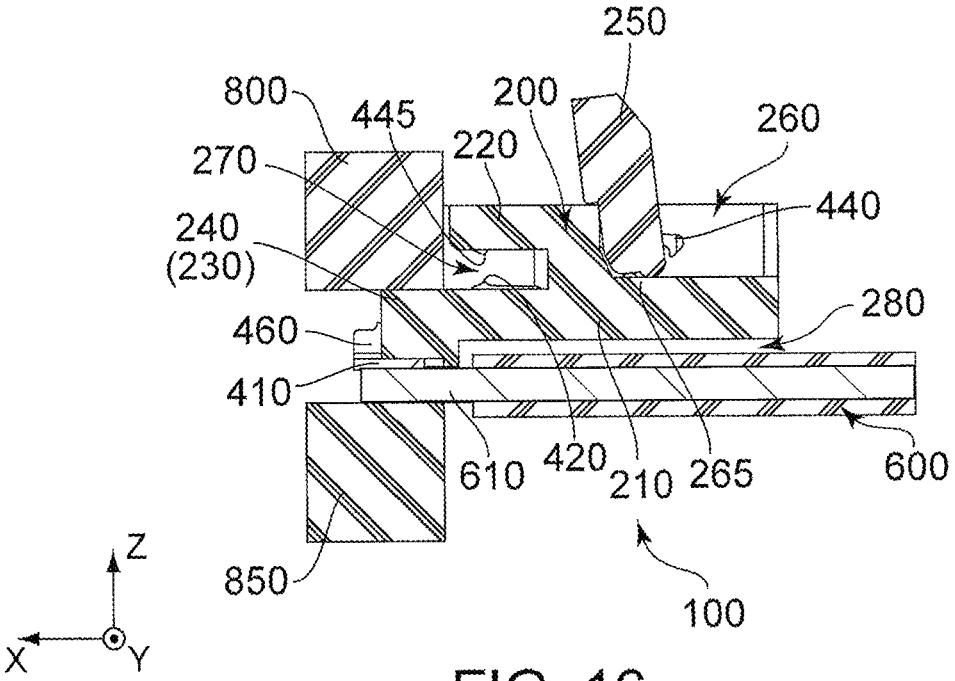
FIG. 16 is a cross-sectional view showing the cable harness of FIG. 14, taken along line D-D.

As shown in FIGS. 6, 7 and 8, the holding member 200 has a holding portion 210, an upper wall portion 220, a lower wall portion 230, terminal holding portions 245, a movable member 250, a movable member accommodating portion 260, a movable member supporting portion 265, a receiving recess 280 and accommodating ditches 290.

Figure 4:
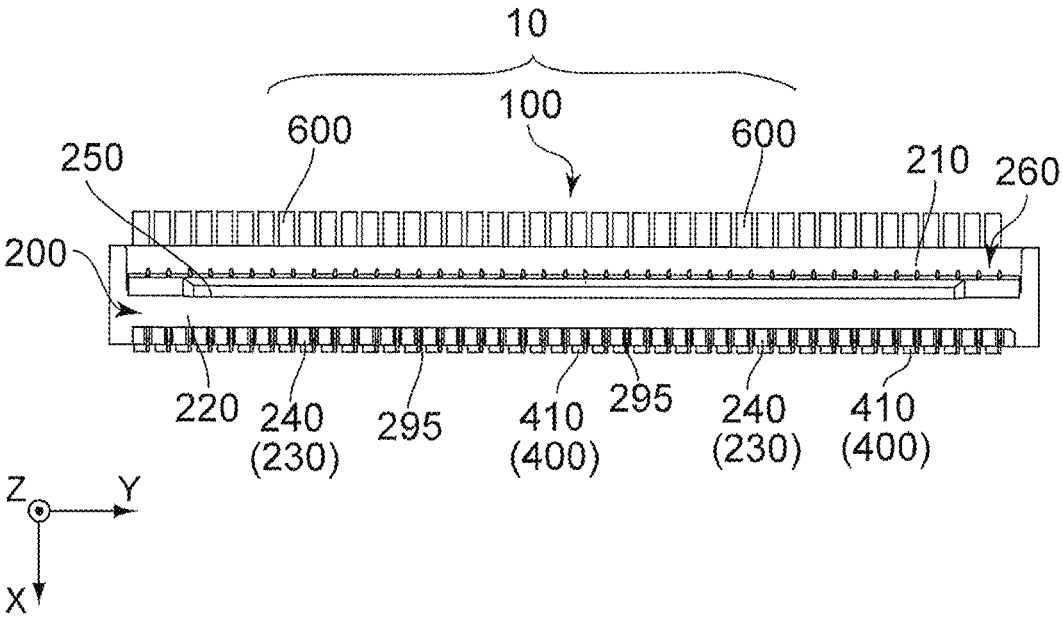
FIG. 4 is a top view showing the cable harness of FIG. 1.

As shown in FIGS. 4, 7 and 8, the upper wall portion 220 is positioned at an upper end of the holding member 200 and has a substantially plate-like shape perpendicular to the up-down direction. The lower wall portion 230 is positioned below the upper wall portion 220 in the up-down direction and has a substantially plate-like shape perpendicular to the up-down direction. The upper wall portion 220 and the lower wall portion 230 are positioned away from each other in the up-down direction. A front end of the upper wall portion 220 is positioned rearward of a front end of the lower wall portion 230 in the front-rear direction. The lower wall portion 230 has a sandwiched portion 240. In other words, the sandwiched portion 240 of the present embodiment is formed as a part of the lower wall portion 230.

As shown in FIGS. 1, 7 and 8, the sandwiched portion 240 is positioned in the vicinity of a front end of the holding member 200, and the holding portion 210 continuously extends from a rear end of the sandwiched portion 240 to reach a rear end of the holding member 200. Specifically, the sandwiched portion 240 is integrally formed with the holding portion 210. The sandwiched portion 240 has an upper surface and a lower surface each of which is perpendicular to the up-down direction.

As shown in FIGS. 1 and 6 to 8, a receiving portion 270 is formed between the upper wall portion 220 and the lower wall portion 230 in the up-down direction. Specifically, the receiving portion 270 has an opening at a front end thereof. The receiving portion 270 receives a part of the second connection object 700 when the second connection object 700 is connected with the connector 100.

Figure 3:
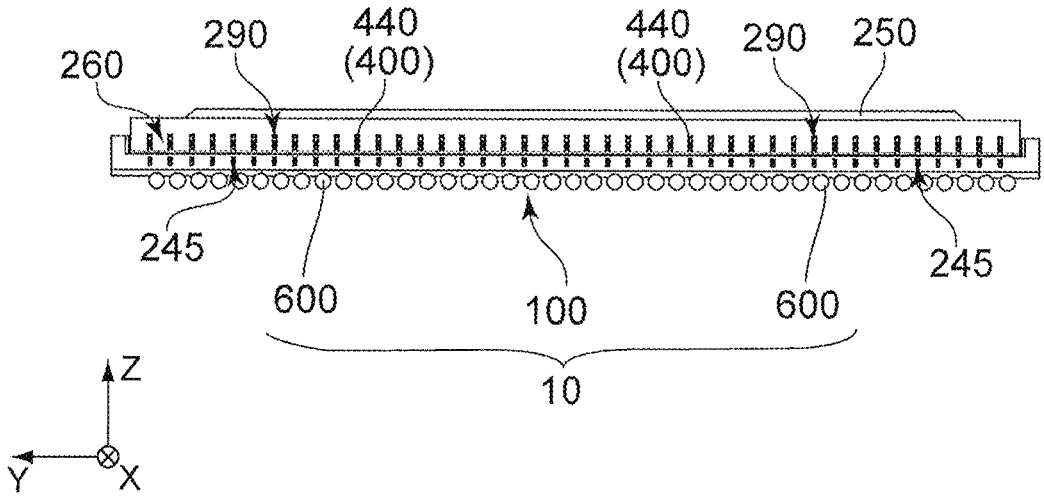
FIG. 3 is a rear view showing the cable harness of FIG. 1.

As shown in FIGS. 3, 7 and 8, each of the terminal holding portions 245 is a hole which connects between the rear end of the holding member 200 and the receiving portion 270 in the front-rear direction.

As shown in FIGS. 1, 3, 7 and 8, the movable member 250 is positioned rearward of the upper wall portion 220 and above the lower wall portion 230. The movable member 250 has a plurality of cam portions 255 each of which extends in a pitch direction perpendicular to both the up-down direction and the front-rear direction. In the present embodiment, the pitch direction is a Y-direction. Each of the cam portions 255 has a substantially elliptical cross-section in a plane perpendicular to the pitch direction. The movable member accommodating portion 260 is positioned in the vicinity of the rear end of the holding member 200. The movable member accommodating portion 260 is a recess which is opened both rearward and upward. The movable member supporting portion 265 is a plane perpendicular to the up-down direction. The movable member supporting portion 265 is a lower surface of the movable member accommodating portion 260.

As understood from FIGS. 7 and 8, the movable member 250 is rotatable relative to the cam portions 255 by turning an end thereof in the front-rear direction.

When the end of the movable member 250 is turned rearward, the movable member 250 is accommodated in the movable member accommodating portion 260. As shown in FIGS. 7 and 8, under a state where the movable member 250 is turned forward to be brought into contact with a rear end of the upper wall portion 220, a short axis of the substantially elliptical cross-section of each of the cam portions 255 is substantially oriented in the up-down direction. Under a state where the movable member 250 is turned rearward to be accommodated in the movable member accommodating portion 260, a long axis of the substantially elliptical cross-section of each of the cam portions 255 is substantially oriented in the up-down direction.

As shown in FIGS. 2, 5 and 7 to 9, the holding member 200 is formed with the receiving recess 280 at a lower part thereof. The receiving recess 280 is recessed upward in the up-down direction and is opened rearward in the front-rear direction. The receiving recess 280 receives a part of each of the cables 600 when the connector 100 is attached to the cables 600, or the first connection object 600.

As shown in FIGS. 3, 6 and 7, each of the accommodating ditches 290 pierces the holding member 200 in the front-rear direction. Each of the accommodating ditches 290 is formed with facing portions 292 and recessed portions 295. More specifically, the facing portions 292 are inner walls of the accommodating ditch 290 which face each other in the pitch direction. The facing portions 292 are formed in the vicinity of a lower end of the accommodating ditch 290. The recessed portions 295 are formed above the facing portions 292, respectively. In other words, the recessed portions 295 are formed at opposite sides of the accommodating ditch 290 in the pitch direction. Each of the recessed portions 295 is recessed outward beyond the corresponding facing portion 292 in the pitch direction. More specifically, each of the recessed portions 295 is opened both forward and upward. Accordingly, referring to FIG. 4, each of the recessed portions 295 is visible when the connector 100 is viewed from above. In addition, referring to FIG. 6, each of the recessed portions 295 is visible when the connector 100 is viewed from a front side thereof. Accordingly, a metal mold can easily be pulled out from the holding member 200 when the recessed portions 295 are molded by the metal mold, and each of the recessed portions 295 can have an increased size.

As understood from FIGS. 6, 7 and 8, each of the terminals 400 is held by the holding portion 210 of the holding member 200. The terminals 400 are arranged in the pitch direction.

As shown in FIGS. 7 and 8, each of the terminals 400 has a connecting portion 410, a lower-jaw portion 430, a contact portion 420, an upper-jaw portion 440, an intermediate portion 450, a coupling portion 460, a cam portion supporter 465 and a held portion 470.

Figure 5:
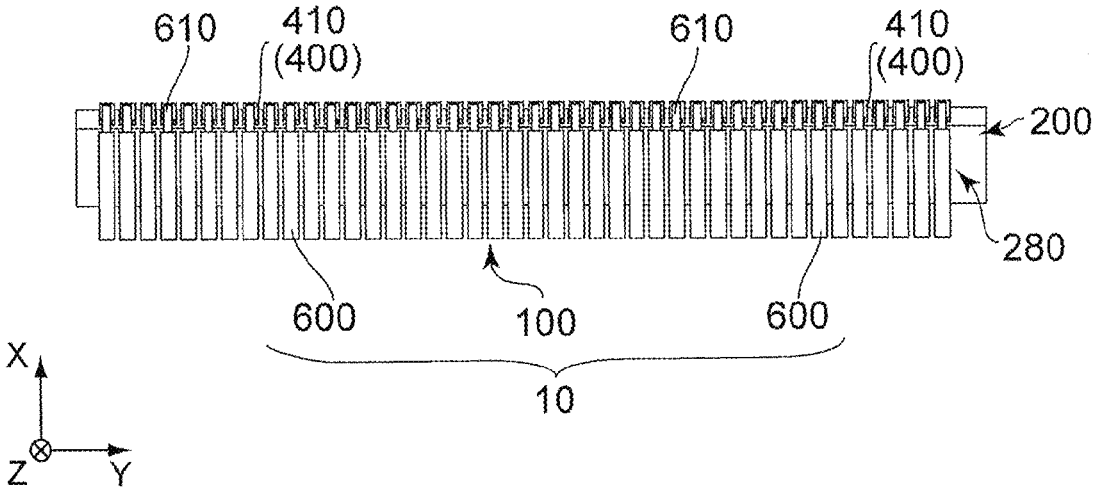
FIG. 5 is a bottom view showing the cable harness of FIG. 1.

As shown in FIGS. 2, 5 and 8, the connecting portions 410 of the terminals 400 are connected with the conductive cores 610 of the cables 600, respectively, when the connector 100 is attached to the cables 600, or the first connection object 600. The connecting portion 410 is positioned at a front end of the terminal 400 in the front-rear direction and is positioned at a lower end thereof in the up-down direction. The connecting portion 410 has a plate-like shape intersecting with the up-down direction. A front end of the connecting portion 410 of the present embodiment is positioned forward beyond a front end of the sandwiched portion 240 of the holding member 200 in the front-rear direction. However, the present invention is not limited thereto. The front end of the connecting portion 410 may be positioned rearward of the front end of the sandwiched portion 240 of the holding member 200, provided that the connecting portion 410 is visible when the connector 100 is viewed along an upward direction of the up-down direction.

As understood from FIGS. 1, 4, 5, 7 and 8, the sandwiched portion 240 of the holding member 200 and the connecting portion 410 of the terminal 400 at least overlap with each other when the connector 100 is viewed along the up-down direction. In other words, the sandwiched portion 240 of the holding member 200 and the connecting portion 410 of the terminal 400 overlap with or are identical with each other when the connector 100 is viewed along the up-down direction. More specifically, the sandwiched portion 240 is positioned upward of the connecting portion 410 in the up-down direction. In the present embodiment, the connecting portion 410 is visible when the connector 100 is viewed along the upward direction of the up-down direction. In the present embodiment, the sandwiched portion 240 and a part of the connecting portion 410 is visible when the connector 100 is viewed along a downward direction of the up-down direction. However, the present invention is not limited thereto. It is enough that one of the sandwiched portion and the connecting portion is visible when the connector is viewed along the upward direction of the up-down direction and that a remaining one of the sandwiched portion and the connecting portion is visible when the connector is viewed along the downward direction of the up-down direction.

As understood from FIGS. 1, 4, 7 and 8, at least in a predetermined region R, the terminal 400 has no portion protruding upward in the up-down direction beyond the lower wall portion 230. The predetermined region R is between the front end of the lower wall portion 230 and a predetermined position P of the sandwiched portion 240 along the front-rear direction. The predetermined position P of the sandwiched portion 240 is positioned at a position same as a position of a rear end of the connecting portion 410 in the front-rear direction.

As shown in FIGS. 7 and 8, the lower-jaw portion 430 extends substantially in the front-rear direction, and a lower edge of the lower-jaw portion 430 is coupled with an upper end of the coupling portion 460. The lower edge of the lower-jaw portion 430 and the connecting portion 410 are positioned away from each other in the up-down direction. The lower-jaw portion 430 has a contact portion supporter 425 which extends forward and upward from a substantially middle part of the lower-jaw portion 430 in the front-rear direction. The contact portion supporter 425 has a cantilever-like shape and is resiliently deformable in the up-down direction with a rear end thereof acting as a fulcrum.

As understood from FIGS. 2, 7 and 8, the contact portions 420 of the terminals 400 are connected with the second connection portions 710, respectively, when the second connection object 700 is inserted into the connector 100.

As shown in FIGS. 6, 7 and 8, the contact portion 420 protrudes upward beyond the lower wall portion 230 in the up-down direction. In other words, an upper end of the contact portion 420 is positioned above an upper surface of the lower wall portion 230 in the up-down direction. More specifically, the contact portion 420 protrudes upward from the lower-jaw portion 430 in the up-down direction. In detail, the contact portion 420 protrudes upward from the vicinity of a front end of the contact portion supporter 425. Since the contact portion supporter 425 is resiliently deformable in the up-down direction as described above, the contact portion 420 is movable in the up-down direction. The contact portion 420 is positioned rearward of the front end of the upper wall portion 220 in the front-rear direction.

As shown in FIG. 6, a center of the contact portion 420 and a center of the connecting portion 410 are positioned at positions different from each other in the pitch direction. As described above, the sandwiched portion 240 is positioned upward of the connecting portion 410 in the up-down direction. Accordingly, if the conductive core 610 of each of the cables 600 is pressed against the connecting portion 410 of the corresponding terminal 400 by a pressing force when the conductive core 610 of each of the cables 600 is soldered on the connecting portion 410 of the corresponding terminal 400, the pressing force is received by the lower surface of the sandwiched portion 240. Thus, each terminal 400 itself is hardly deformed.

As shown in FIGS. 7 and 8, the connecting portion 410 of the present embodiment is positioned forward of the contact portion 420 in the front-rear direction.

As shown in FIGS. 7 and 8, the upper-jaw portion 440 extends in the front-rear direction and has a pressing portion 445 which protrudes downward in the up-down direction. The pressing portion 445 is positioned in the vicinity of a front end of the upper-jaw portion 440 in the front-rear direction.

As shown in FIGS. 7 and 8, the lower-jaw portion 430 and the upper-jaw portion 440 are positioned away from each other in the up-down direction. The contact portion 420 and the pressing portion 445 substantially face each other in the up-down direction.

As shown in FIGS. 7 and 8, the intermediate portion 450 connects the lower-jaw portion 430 and the upper-jaw portion 440 with each other in the up-down direction. More specifically, the intermediate portion 450 connects a substantially middle part of the lower-jaw portion 430 in the front-rear direction and a substantially middle part of the upper-jaw portion 440 in the front-rear direction with each other in the up-down direction. In other words, the upper-jaw portion 440 is connected only with an upper end of the intermediate portion 450. Accordingly, the upper-jaw portion 440 is movable in a seesaw manner with the upper end of the intermediate portion 450 acting as a fulcrum.

As shown in FIGS. 7 and 8, the coupling portion 460 couples the lower edge of the lower-jaw portion 430 and an upper end of the connecting portion 410 with each other in the up-down direction.

As understood from FIGS. 1, 6 and 7, the accommodating ditches 290 of the holding member 200 accommodate the terminals 400, respectively. More specifically, each of the facing portions 292 of each of the accommodating ditches 290 of the holding member 200 faces each of the lower-jaw portion 430 and the coupling portion 460 of the corresponding terminal 400 in the pitch direction. In addition, each of the recessed portions 295 of each of the accommodating ditches 290 of the holding member 200 faces the lower-jaw portion 430 of the corresponding terminal 400 in the pitch direction. In other words, the facing portions 292 of the accommodating ditch 290 are positioned at opposite outer areas, respectively, of each of the lower-jaw portion 430 and the coupling portion 460 of the corresponding terminal 400 in the pitch direction. In addition, the recessed portions 295 of the accommodating ditch 290 are positioned at opposite outer areas, respectively, of the lower-jaw portion 430 of the corresponding terminal 400 in the pitch direction.

As shown in FIGS. 7 and 8, the cam portion supporter 465 is a part of the lower-jaw portion 430 and is positioned rearward of the intermediate portion 450 in the front-rear direction. The terminals 400 correspond to the cam portions 255, respectively. An upper edge of the cam portion supporter 465 of each of the terminals 400 is brought into contact with the corresponding cam portion 255 of the movable member 250 in the up-down direction.

As shown in FIGS. 7 and 8, the held portion 470 extends rearward from a rear end of the lower-jaw portion 430 of the terminal 400. The held portion 470 is press-fit into the terminal holding portion 245 of the holding member 200.

Referring to FIGS. 10 to 16, the connections of the connecting portions 410 of the terminals 400 of the connector 100 and the conductive cores 610, or the first connection portions 610, of the cables 600, or the first connection object 600, are done in a manner described below.

First, the connecting portions 410 each on which solder is placed are brought into contact with the conductive cores 610 of the cables 600, respectively, in the up-down direction, and a support 800 is brought into contact with the upper surface of the sandwiched portion 240 of the holding member 200 of the connector 100 while a heating tool 850 is brought into contact with a lower end of the conductive core 610 of each of the cables 600. In this situation, the sandwiched portion 240, the connecting portion 410 of each of the terminals 400 and the conductive core 610 of each of the cables 600 are sandwiched between the support 800 and the heating tool 850 in the up-down direction. Meanwhile, the support 800 is brought into contact with the upper surface of the sandwiched portion 240 so that a lower surface of the support 800 includes the predetermined region R of the sandwiched portion 240.

Next, the heating tool 850 heats the conductive core 610 of each of the cables 600 while pressing the conductive core 610 of each of the cables 600 upward to apply an upward pressing force thereto. Meanwhile, the upward pressing force by the heating tool 850 is received by the support 800 through the sandwiched portion 240, so that each of the conductive cores 610 is sufficiently pressed against the corresponding connecting portion 410. Accordingly, the solder placed on each of the connecting portions 410 is melted, so that the conductive cores 610 of the cables 600 are simultaneously soldered to the connecting portions 410 of the terminals 400.

As described above, the recessed portions 295 of the present embodiment are formed at the opposite sides of the accommodating ditch 290, which accommodates the terminal 400, in the pitch direction. Accordingly, even if surplus melted solder flows up by capillary action through a part of the accommodating ditch 290, which is defined by the facing portions 292, when the conductive core 610 of each of the cables 600 is soldered to the connecting portion 410 of the corresponding terminal 400 as described above, the surplus melted solder which flows up through the part of the accommodating ditch 290 is trapped in the recessed portions 295 which are positioned above the facing portions 292, respectively. Thus, the surplus melted solder is prevented from flowing up to the upper surface of the lower wall portion 230. Especially, in the connector 100 of the present embodiment, each of the recessed portions 295 can have the increased size as described above, so that the surplus melted solder which flows up through the part of the accommodating ditch 290 can be fully trapped therein.

As described above, the terminal 400 has no portion protruding upward in the up-down direction beyond the lower wall portion 230 at least in the predetermined region R. Accordingly, a member having a plane surface which is not grooved can be used as the support 800. Thus, the connector 100 of the present embodiment has an advantage that the support 800 can be formed at lower cost.

Referring to FIGS. 2, 7 and 8, the connection of the connector 100 and the second connection object 700 such as an FPC is done in a manner described below.

First, when the second connection object 700 such as an FPC is moved rearward toward the receiving portion 270 of the connector 100 under a state where the movable member 250 of the connector 100 is turned forward, a rear part of the second connection object 700 is positioned in the receiving portion 270 of the connector 100. Meanwhile, each of the second connection portions 710 which are positioned at a lower surface of the second connection object 700 is positioned above the contact portion 420 of the corresponding terminal 400 of the connector 100. Next, when the movable member 250 is turned rearward so as to be accommodated in the movable member accommodating portion 260, each of the cam portions 255 of the movable member 250 is rotated so that the long axis of the substantially elliptical cross-section thereof is substantially oriented in the up-down direction as described above. Accordingly, each of the cam portions 255 pushes upward a lower edge of the vicinity of a rear end of the upper-jaw portion 440 of the corresponding terminal 400 to apply an upward force thereto, so that the upper-jaw portion 440 is moved in a seesaw manner with the upper end of the intermediate portion 450 acting as the fulcrum while the pressing portion 445 which is positioned in the vicinity of the front end of the upper-jaw portion 440 is moved downward. Thus, the second connection object 700 is sandwiched by the pressing portions 445 and the contact portions 420 in the up-down direction, so that the contact portion 420 of each of the terminals 400 of the connector 100 is securely connected with the corresponding second connection portion 710 of the second connection object 700.

Removal of the second connection object 700 from the connector 100 is done in the reverse of the aforementioned manner of the connection. Specifically, when the movable member 250 is turned forward to be brought into contact with the rear end of the upper wall portion 220, each of the cam portions 255 is rotated so that the short axis of the substantially elliptical cross-section of each of the cam portions 255 is substantially oriented in the up-down direction. Accordingly, the upward force which is applied to the lower edge of the vicinity of the rear end of the upper-jaw portion 440 is released. Thus, the upper-jaw portion 440 is moved in a seesaw manner with the upper end of the intermediate portion 450 acting as the fulcrum while the pressing portion 445 of the upper-jaw portion 440 is moved upward. Therefore, the second connection object 700 is not sandwiched by the pressing portions 445 and the contact portions 420, so that the second connection object 700 is in a state where the second connection object 700 is able to be pulled forward out from the connector 100. Consequently, the connection of the connector 100 and the second connection object 700 is released by the second connection object 700 being pulled forward out therefrom in the aforementioned state.

The structure of the cable harness 10 is not limited thereto. For example, the cable harness 10 can be modified as described below.

Figure 17:
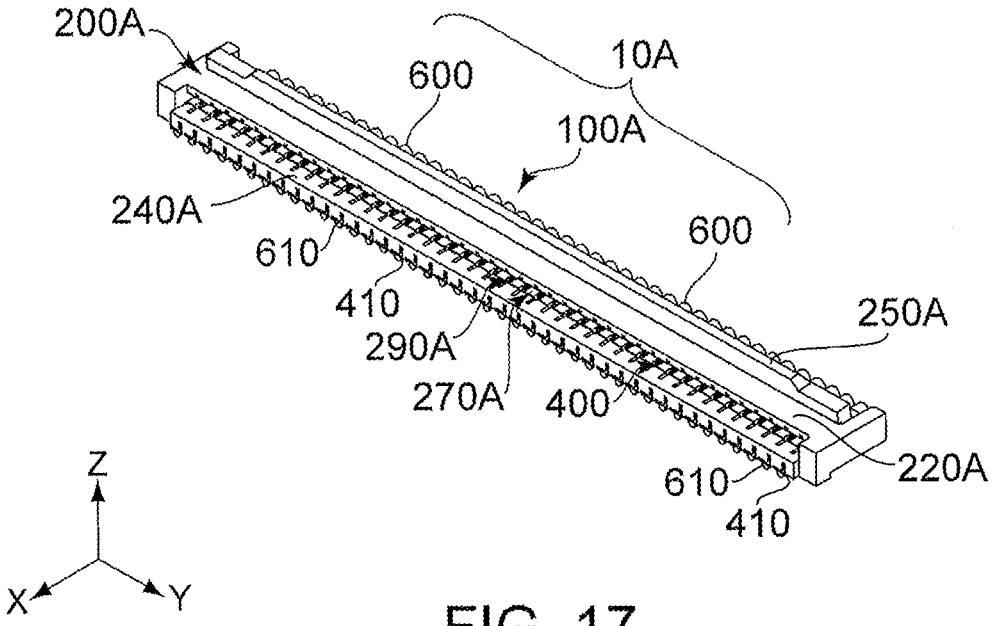
FIG. 17 is a perspective view showing a cable harness according to a modification.
Figure 18:
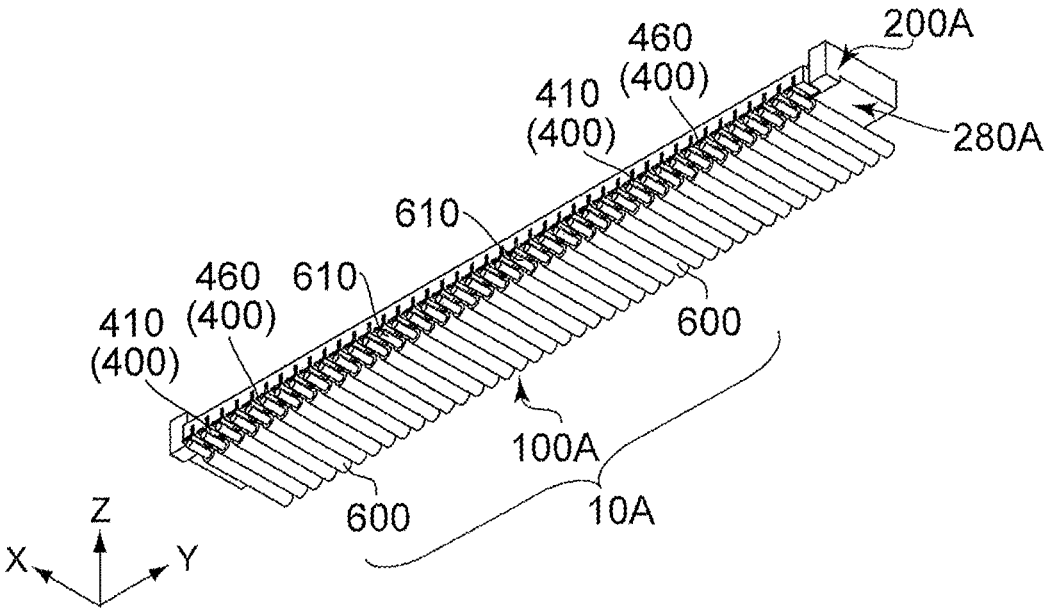
FIG. 18 is another perspective view showing the cable harness of FIG. 17.
Figure 19:
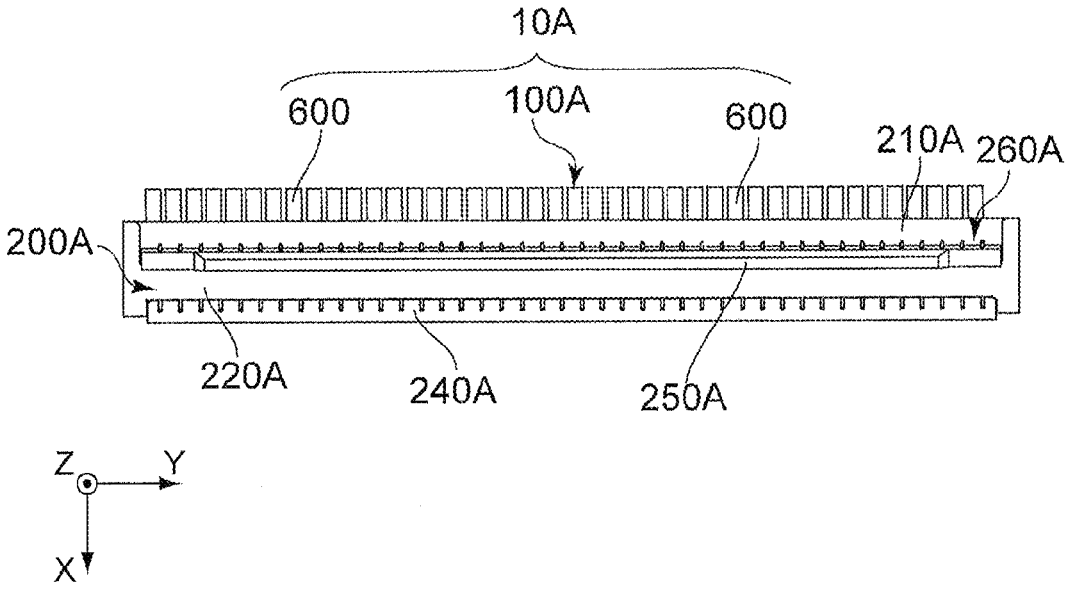
FIG. 19 is a top view showing the cable harness of FIG. 17.

Referring to FIGS. 17 and 18, a cable harness 10A according to a modification of the present invention has a structure generally same as the structure of the cable harness 10 according to the aforementioned first embodiment as shown in FIG. 1. Accordingly, components similar to those of the first embodiment among components illustrated in FIGS. 17 to 22 will be designated by the same reference numerals as those of the first embodiment.

As shown in FIGS. 17 and 18, the cable harness 10A according to the modification comprises a connector 100A and cables 600. The cable 600 of the present embodiment has a structure same as that of the cable harness 10 of the aforementioned first embodiment. Accordingly, detailed explanation thereabout is omitted.

As shown in FIGS. 17 and 18, the connector 100A comprises a holding member 200A and a plurality of terminals 400. The terminal 400 of the present embodiment has a structure same as that of the connector 100 of the aforementioned first embodiment. Accordingly, detailed explanation about the terminal 400 is omitted.

As shown in FIGS. 17 to 22, the holding member 200A has a holding portion 210A, a sandwiched portion 240A, an upper wall portion 220A, a lower wall portion 230A, terminal holding portions 245A, a movable member 250A, a movable member accommodating portion 260A, a movable member supporting portion 265A, a receiving recess 280A and accommodating ditches 290A. Components other than the holding portion 210A, the sandwiched portion 240A and the lower wall portion 230A among the aforementioned components of the holding member 200A of the present embodiment have structures same as those of the connector 100 of the first embodiment. Accordingly, detailed explanation about the components other than the holding portion 210A, the sandwiched portion 240A and the lower wall portion 230A is omitted.

Figure 20:
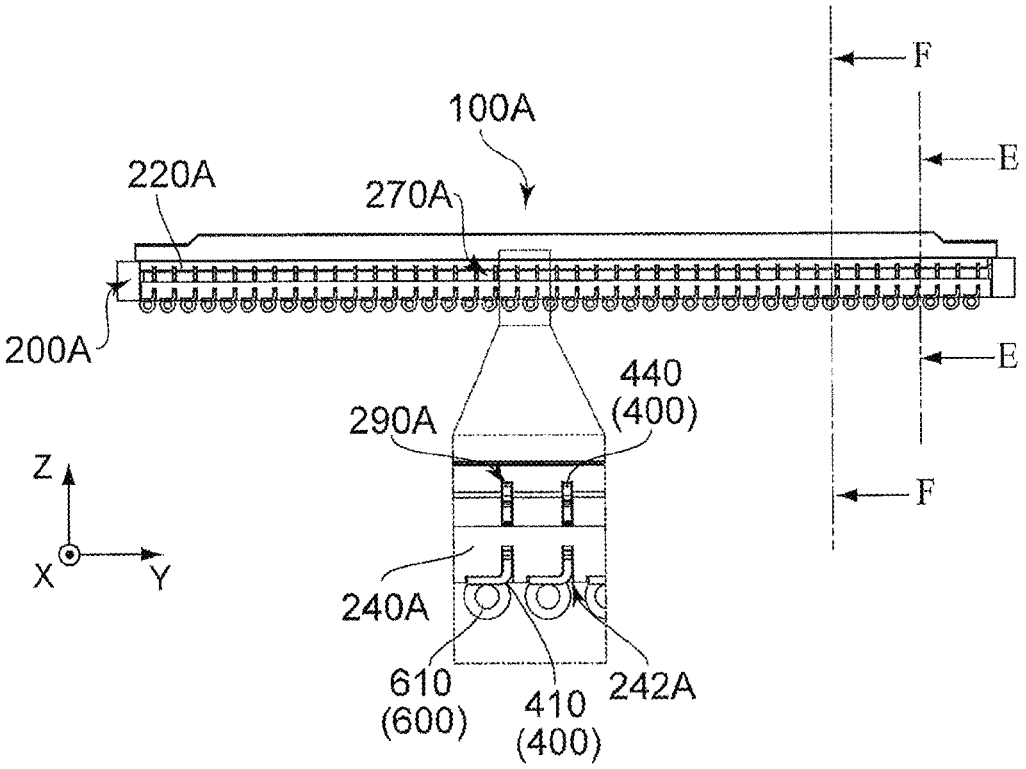
FIG. 20 is a front view showing the cable harness of FIG. 17, wherein a part of the cable harness is illustrated enlarged.
Figure 21:
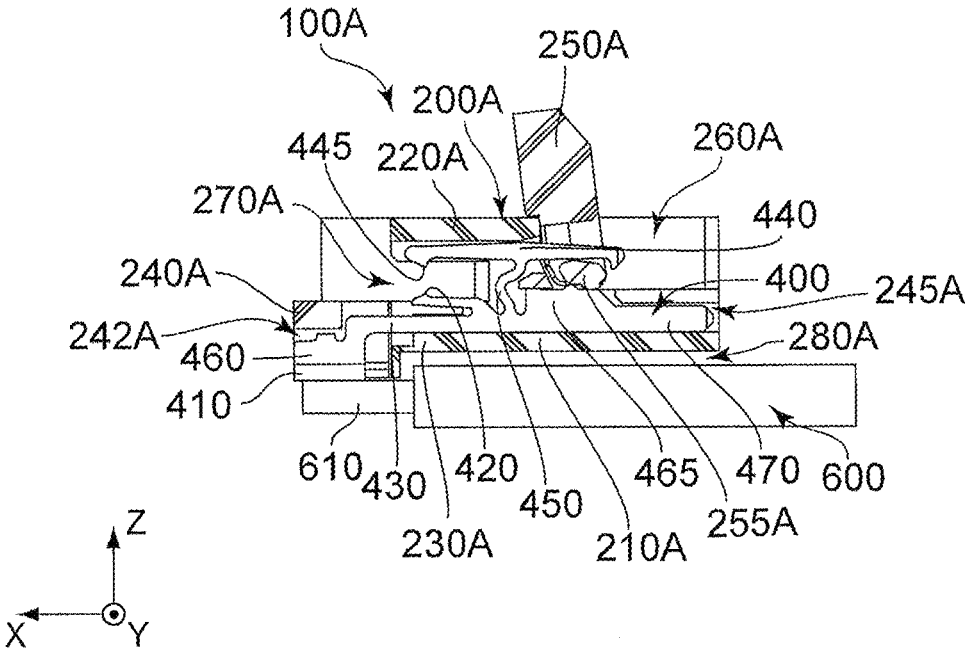
FIG. 21 is a cross-sectional view showing the cable harness of FIG. 20, taken along line E-E.
Figure 22:
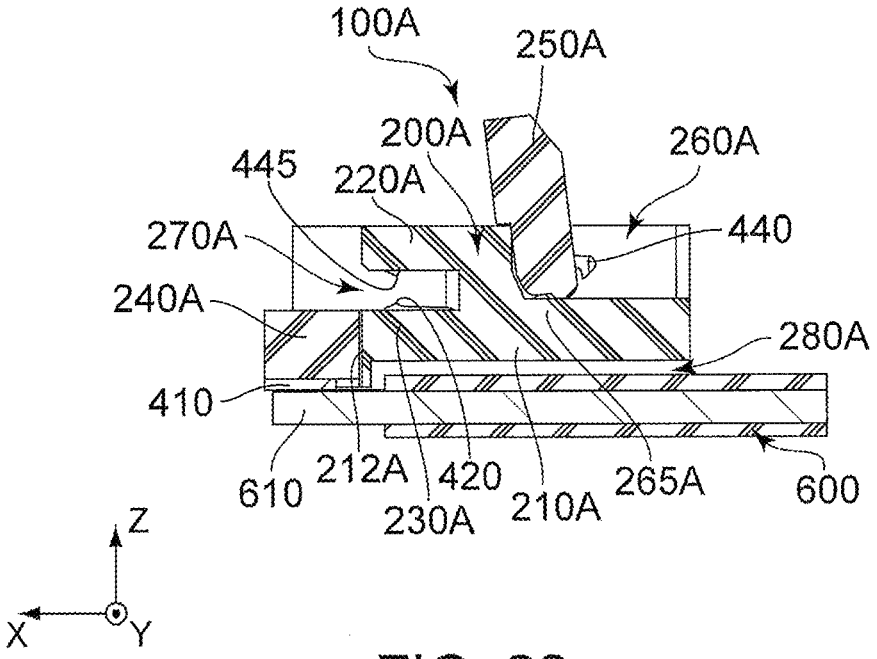
FIG. 22 is a cross-sectional view showing the cable harness of FIG. 20, taken along line F-F.

As shown in FIGS. 20 to 22, the holding portion 210A of the present embodiment has a front surface 212A perpendicular to the front-rear direction. The front surface 212A of the holding portion 210A is positioned at a position same as a position of a front end of the upper wall portion 220A in the front-rear direction.

As shown in FIGS. 20 to 22, the sandwiched portion 240A has a rectangular bar-like shape extending in the pitch direction. Specifically, the sandwiched portion 240A of the present embodiment has a front surface, a rear surface, an upper surface and a lower surface. Each of the front surface and the rear surface of the sandwiched portion 240A is perpendicular to the front-rear direction. Each of the upper surface and the lower surface of the sandwiched portion 240A is perpendicular to the up-down direction. The sandwiched portion 240A of the present embodiment is distinct and separated from the holding portion 210A. The front surface 212A of the holding portion 210A is in contact with the rear surface of the sandwiched portion 240A in the front-rear direction. The sandwiched portion 240A is formed with a plurality of coupling portion accommodating ditches 242A.

As shown in FIGS. 20 to 22, each of the coupling portion accommodating ditches 242A is opened at both the front surface and the lower surface of the sandwiched portion 240A. Each of the coupling portion accommodating ditches 242A communicates each of the front surface and the lower surface of the sandwiched portion 240A with the upper surface of the sandwiched portion 240A. The coupling portion accommodating ditch 242A accommodates the coupling portion 460 and the vicinity of a front end of the lower-jaw portion 430.

As understood from FIGS. 17 to 22, since the connector 100A of the present embodiment has the structure wherein the sandwiched portion 240A is distinct and separated from the holding portion 210A, it is easy to insert each of the terminals 400 into the holding portion 210A of the holding member 200A of the connector 100A. Furthermore, in the connector 100A of the present embodiment, the sandwiched portion 240A which is distinct and separated therefrom can be attached to the terminals 400 after the terminals 400 are inserted into the holding portion 210A of the holding member 200A. Accordingly, it is easy to assemble the connector 100A.

Connections of connecting portions 410 of the terminals 400 of the connector 100A and the conductive cores 610 of the cables 600 are done in a manner similar to those of the connector 100 of the aforementioned first embodiment. Accordingly, detailed explanation thereabout is omitted.

Connection of the connector 100A and the second connection object 700 such as an FPC is done in a manner similar to that of the connector 100 of the aforementioned first embodiment. Accordingly, detailed explanation thereabout is omitted.

Second Embodiment

Figure 23:
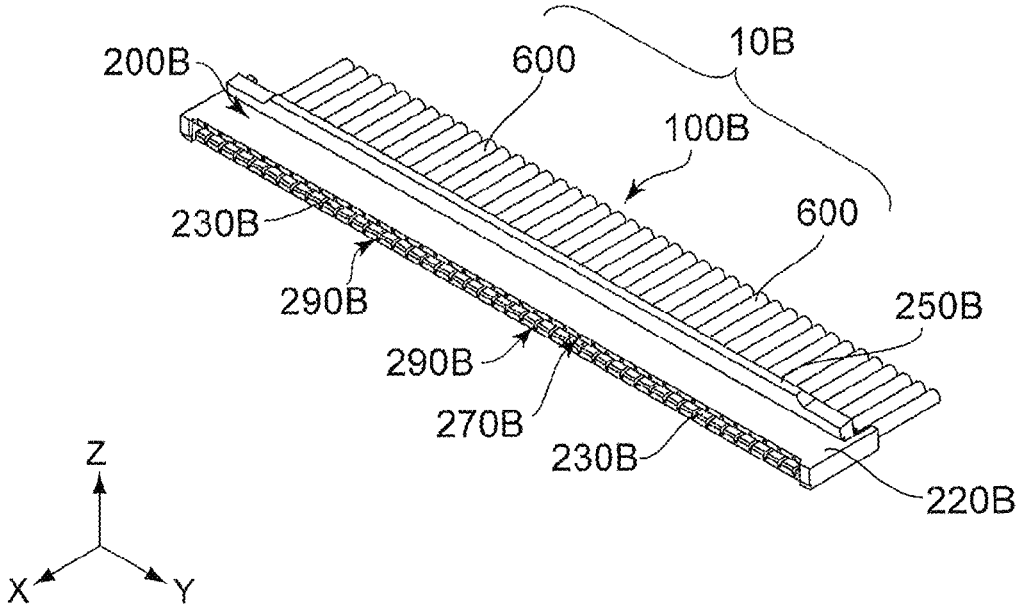
FIG. 23 is a perspective view showing a cable harness comprising a cable and a connector according to a second embodiment of the present invention.
Figure 24:
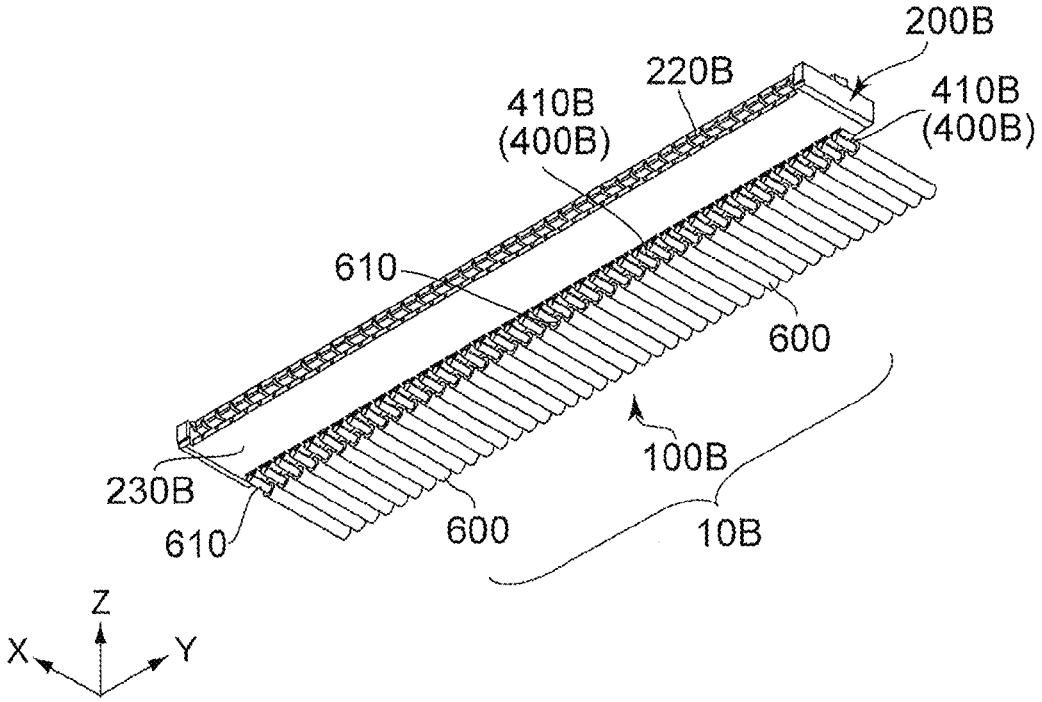
FIG. 24 is another perspective view showing the cable harness of FIG. 23.
Figure 25:
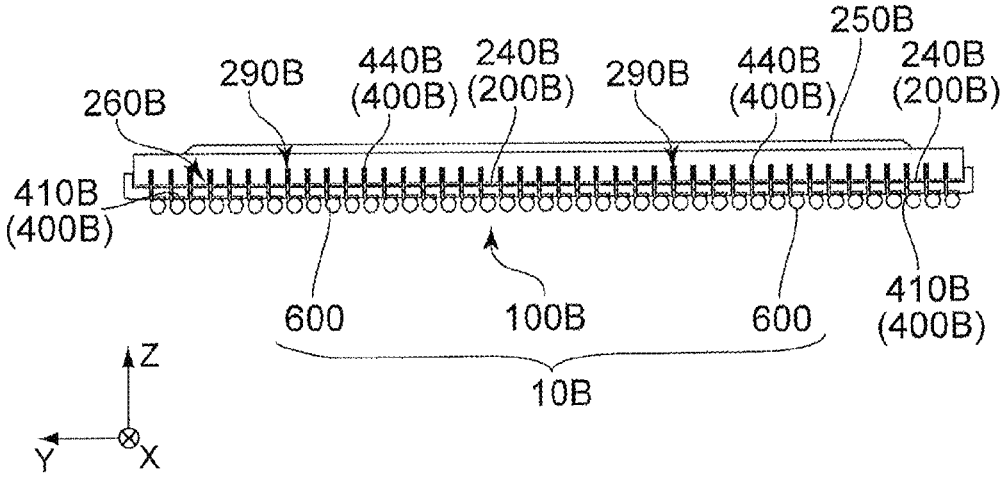
FIG. 25 is a rear view showing the cable harness of FIG. 23.
Figure 26:
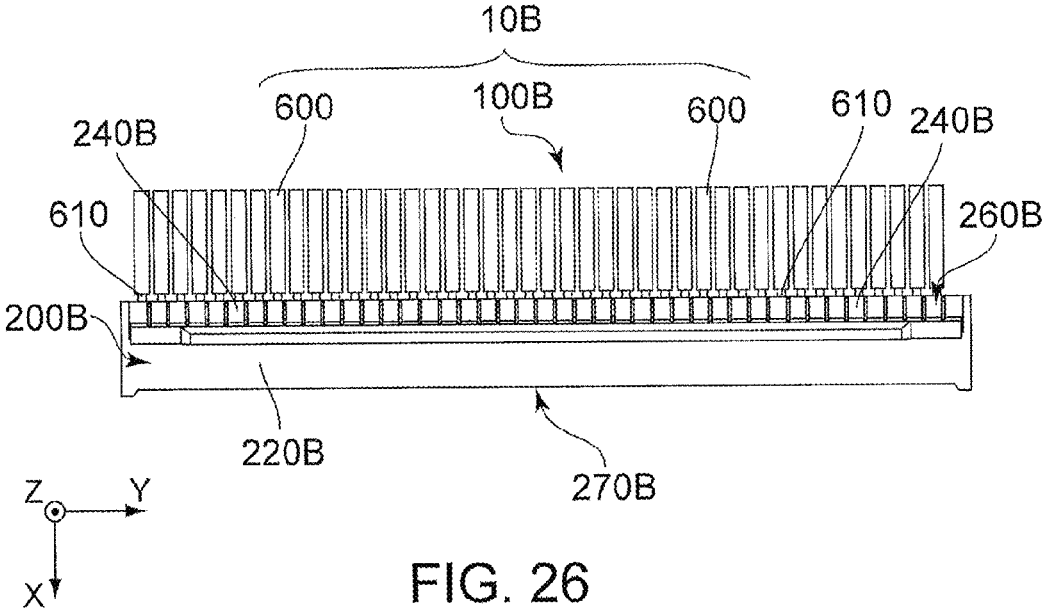
FIG. 26 is a top view showing the cable harness of FIG. 23.
Figure 27:
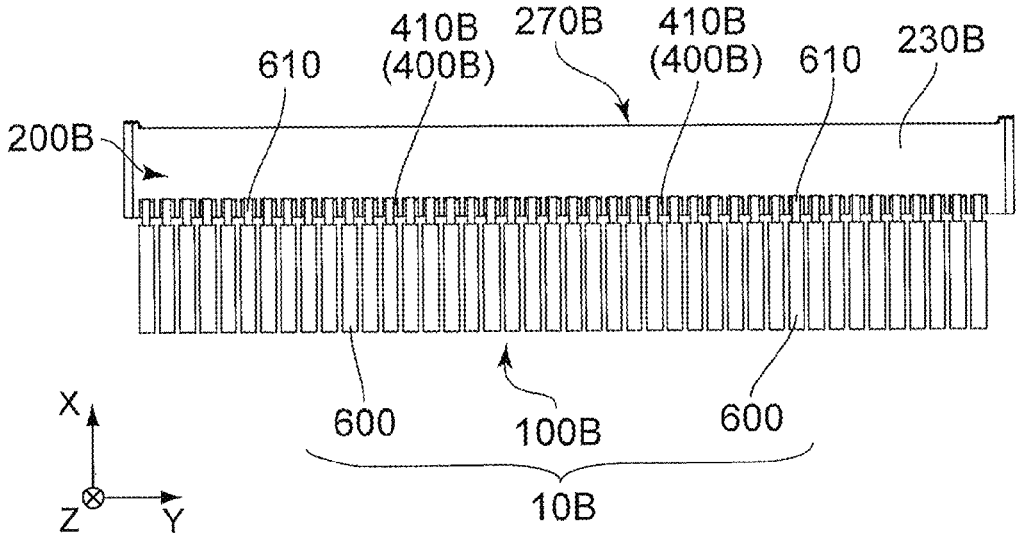
FIG. 27 is a bottom view showing the cable harness of FIG. 23.

Referring to FIGS. 23 and 24, a cable harness 10B of a second embodiment of the present invention has a structure generally same as the structure of the cable harness 10 of the first embodiment as shown in FIG. 1. Accordingly, components similar to those of the first embodiment among components illustrated in FIGS. 23 to 30 will be designated by the same reference numerals as those of the first embodiment. As for directions and orientations in the present embodiment, expressions same as those of the first embodiment will be used hereinbelow.

As shown in FIGS. 23 and 24, the cable harness 10B according to the present embodiment comprises a connector 100B and cables 600. The cable 600 of the present embodiment has a structure same as that of the cable harness 10 of the aforementioned first embodiment. Accordingly, detailed explanation thereabout is omitted.

Referring to FIGS. 1, 2, 23 and 24, the connector 100B according to the second embodiment of the present invention is attachable to a first connection object 600 such as the cables 600 in the up-down direction. In addition, the connector 100B of the present embodiment is connectable with a second connection object 700 such as an FPC or an FFC which is to be inserted rearward into the connector 100B along the front-rear direction perpendicular to the up-down direction.

As shown in FIGS. 23 to 30, the connector 100B comprises a holding member 200B and a plurality of terminals 400B As shown in FIGS. 23 to 30, the holding member 200B has a sandwiched portion 240B, a holding portion 210B, an upper wall portion 220B, a lower wall portion 230B, a movable member 250B, a movable member accommodating portion 260B, a movable member supporting portion 265B and accommodating ditches 290B.

Components other than the holding portion 210B and the sandwiched portion 240B among the aforementioned components of the holding member 200B of the present embodiment have structures same as those of the connector 100 of the aforementioned first embodiment. Accordingly, detailed explanation thereabout is omitted.

Figure 29:
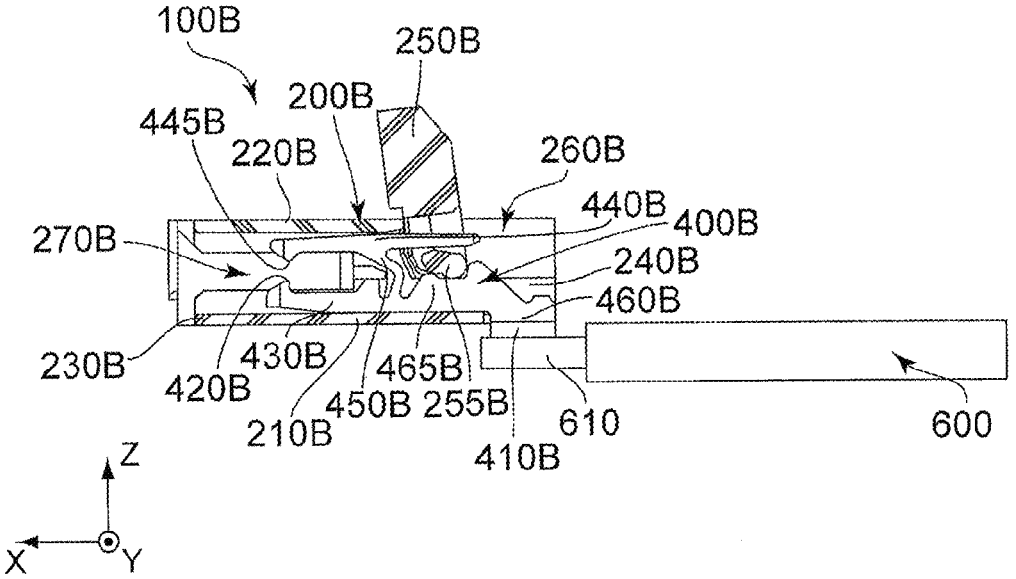
FIG. 29 is a cross-sectional view showing the cable harness of FIG. 28, taken along line G-G.
Figure 30:
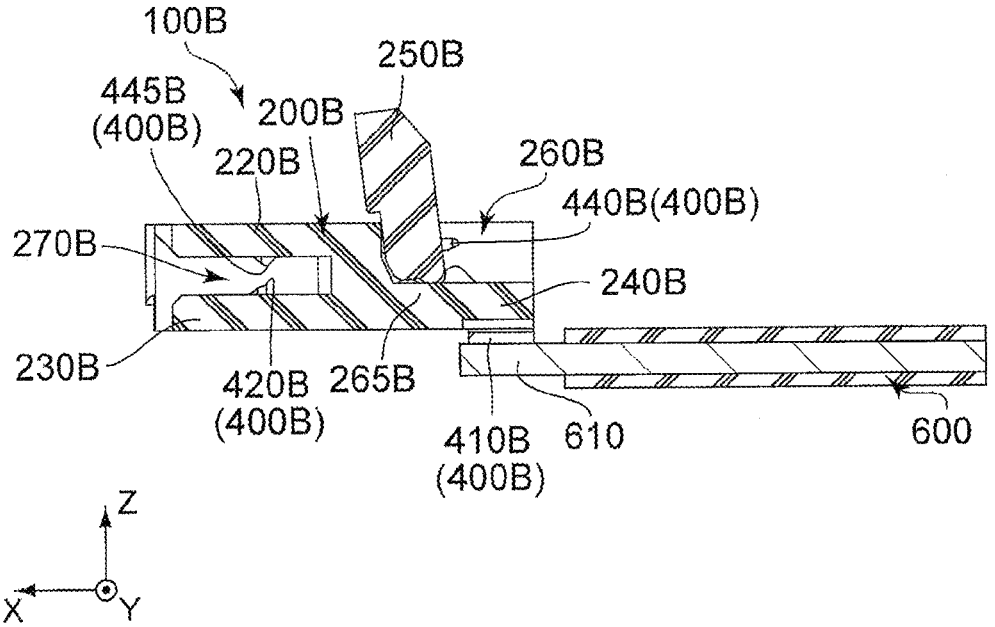
FIG. 30 is a cross-sectional view showing the cable harness of FIG. 28, taken along line H-H.
Figure 31:
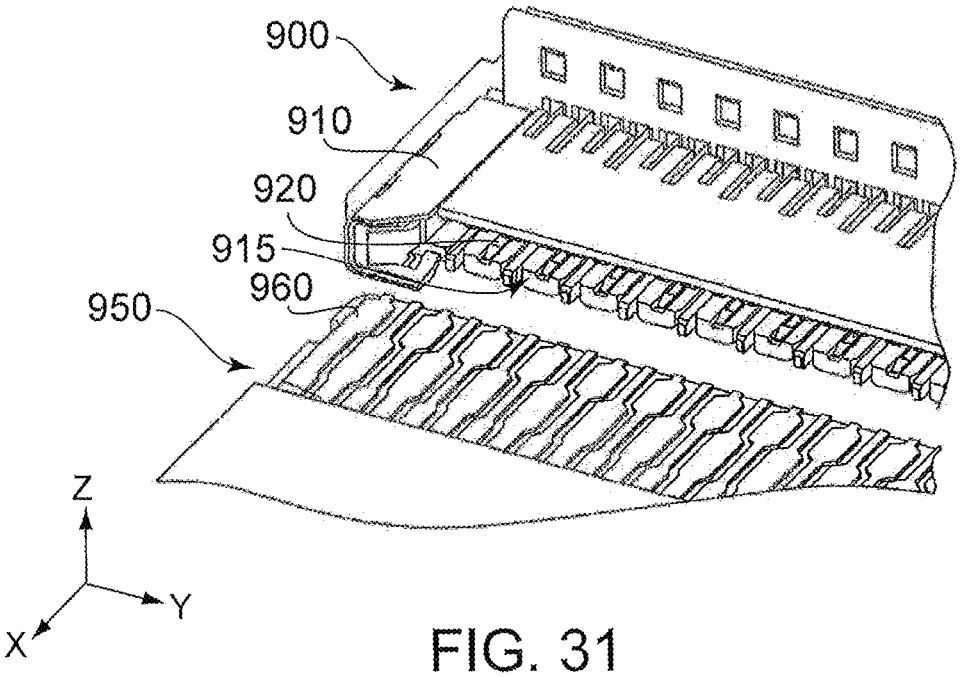
FIG. 31 PRIOR ART
FIG. 31 is a perspective view showing a connector and a flexible printed circuit of Patent Document 1.
Figure 32:
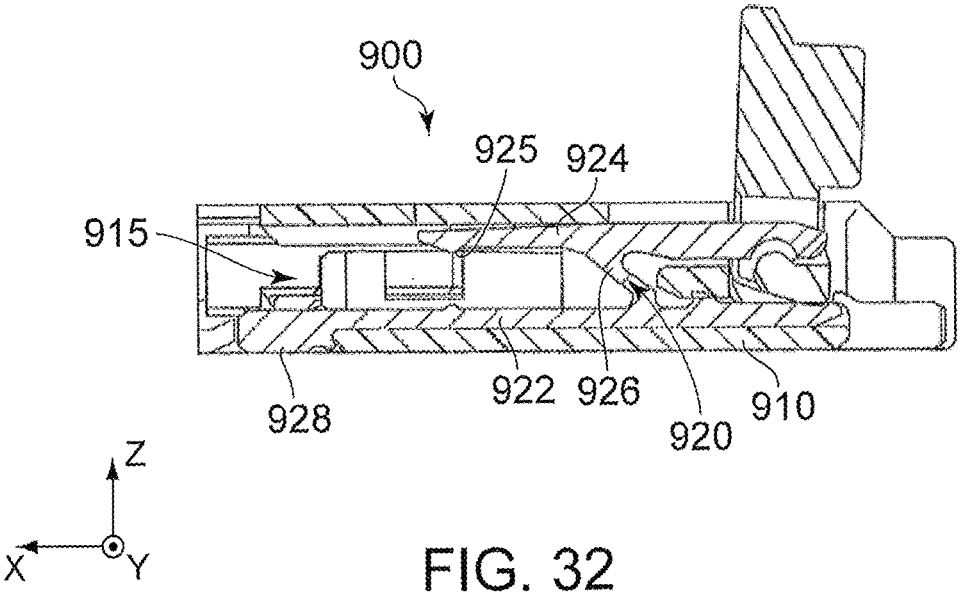
FIG. 32 PRIOR ART
FIG. 32 is a cross-sectional view showing the connector of FIG. 31.

As shown in FIGS. 29 and 30, the sandwiched portion 240B is positioned in the vicinity of a rear end of the holding member 200B in the front-rear direction. The sandwiched portion 240B has an upper surface and a lower surface each of which is perpendicular to the up-down direction.

As shown in FIGS. 29 and 30, the holding portion 210B extends forward from the sandwiched portion 240B in the front-rear direction. Specifically, the sandwiched portion 240B of the present embodiment is integrally formed with the holding portion 210B.

As shown in FIGS. 29 and 30, each of the terminals 400B has a connecting portion 410B, a contact portion 420B, a lower-jaw portion 430B, an upper-jaw portion 440B, an intermediate portion 450B, a coupling portion 460B and a cam portion supporter 465B. As for the aforementioned components of the terminal 400B, the upper-jaw portion 440B, the intermediate portion 450B and the cam portion supporter 465B have structures same as those of the terminal 400 of the connector 100 of the aforementioned first embodiment. Accordingly, detailed explanation thereabout is omitted.

Figure 28:
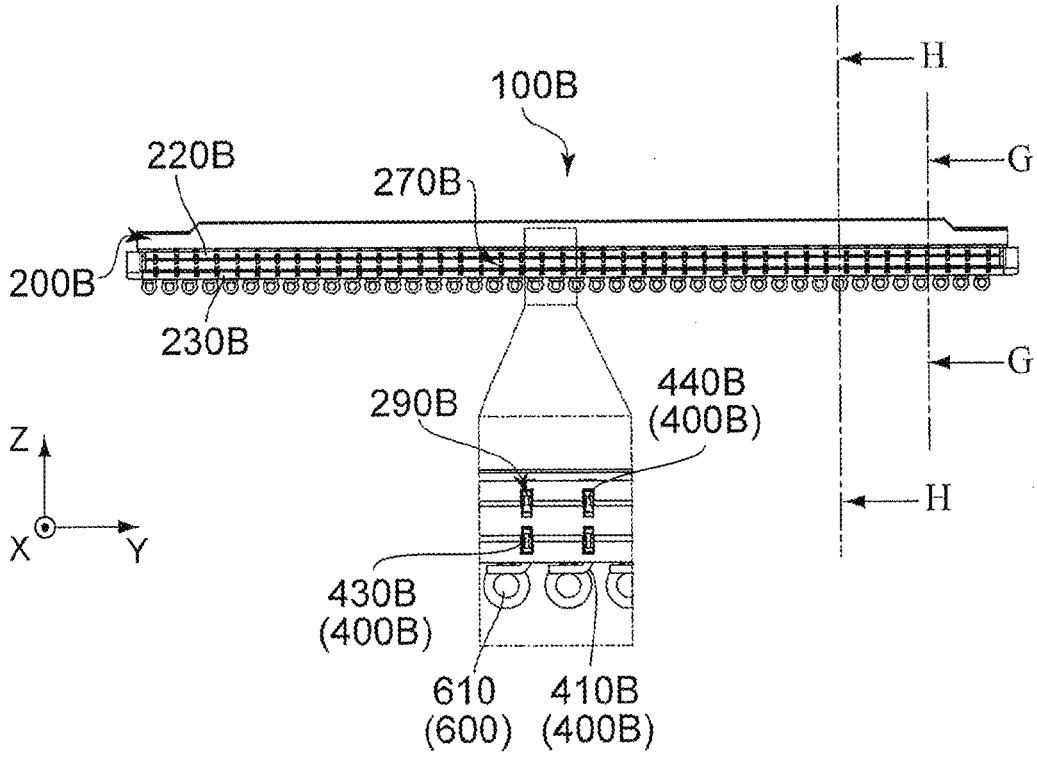
FIG. 28 is a front view showing the cable harness of FIG. 23, wherein a part of the cable harness is illustrated enlarged.

As shown in FIGS. 28 to 30, the connecting portions 410B of the terminals 400B are connected with conductive cores 610 of the cables 600, respectively, when the connector 100B is attached to the cables 600. The connecting portion 410B of the present embodiment is positioned rearward of the contact portion 420B in the front-rear direction. More specifically, the connecting portion 410B of the present embodiment is positioned at a rear end of the terminal 400B in the front-rear direction and is positioned at a lower end thereof in the up-down direction. The connecting portion 410B of the present embodiment has a plate-like shape intersecting with the up-down direction.

As understood from FIGS. 26, 27, 29 and 30, the sandwiched portion 240B of the holding member 200B and the connecting portion 410B of the terminal 400B at least overlap with each other when the connector 100B is viewed along the up-down direction. In other words, the sandwiched portion 240B of the holding member 200B and the connecting portion 410B of the terminal 400B overlap with or are identical with each other when the connector 100B is viewed along the up-down direction. More specifically, the sandwiched portion 240B is positioned upward of the connecting portion 410B in the up-down direction. In the present embodiment, the connecting portion 410B is visible when the connector 100B is viewed along the upward direction of the up-down direction. Furthermore, in the present embodiment, the sandwiched portion 240B is visible when the connector 100B is viewed along the downward direction of the up-down direction. However, the present invention is not limited thereto. It is enough that one of the sandwiched portion and the connecting portion is visible when the connector is viewed along the upward direction of the up-down direction and that a remaining one of the sandwiched portion and the connecting portion is visible when the connector is viewed along the downward direction of the up-down direction.

As shown in FIGS. 29 and 30, the lower-jaw portion 430B extends in the front-rear direction to reach the rear end of the holding member 200B. More specifically, the lower-jaw portion 430B extends forward and upward. The lower-jaw portion 430B is resiliently deformable in the up-down direction. The lower-jaw portion 430B and the upper-jaw portion 440B are positioned away from each other in the up-down direction.

As shown in FIGS. 29 and 30, a lower edge of the lower-jaw portion 430B is connected with an upper end of the coupling portion 460B. The lower edge of the lower-jaw portion 430B and the connecting portion 410B are positioned away from each other in the up-down direction.

As understood from FIGS. 2, 29 and 30, the contact portions 420B of the terminals 400B are connected with second connection portions 710, respectively, when the second connection object 700 is inserted into the connector 100B.

As shown in FIGS. 29 and 30, the contact portion 420B protrudes upward in the up-down direction from the vicinity of a front end of the lower-jaw portion 430B. Specifically, an upper end of the contact portion 420B is positioned above and away from an upper surface of the lower wall portion 230B. Since the lower-jaw portion 430B is resiliently deformable in the up-down direction as described above, the contact portion 420B is movable in the up-down direction. The contact portion 420B is positioned rearward of each of a front end of the upper wall portion 220B and a front end of the lower wall portion 230B in the front-rear direction.

As understood from FIGS. 28 to 30, a center of the contact portion 420B and a center of the connecting portion 410B are positioned at positions different from each other in the pitch direction. Accordingly, if the conductive core 610 of each of the cables 600 is pressed against the connecting portion 410B of the corresponding terminal 400B by a pressing force when the conductive core 610 of each of the cables 600 is soldered on the connecting portion 410B of the corresponding terminal 400, the pressing force is received by the lower surface of the sandwiched portion 240B, so that each terminal 400B itself is hardly deformed.

As shown in FIGS. 29 and 30, the coupling portion 460B of the present embodiment is positioned at the rear end of the terminal 400B in the front-rear direction. The coupling portion 460B couples a lower edge of a rear end of the lower-jaw portion 430B and an upper end of the connecting portion 410B with each other.

The connections of the connecting portions 410B of the terminals 400B of the connector 100B and the conductive cores 610, or the first connection portions 610, of the cables 600, or the first connection object 600, are done in a manner similar to those of the connector 100 of the aforementioned first embodiment. Accordingly, detailed explanation thereabout is omitted.

The connection of the connector 100B and the second connection object 700 such as an FPC is done in a manner similar to that of the connector 100 of the aforementioned first embodiment. Accordingly, detailed explanation thereabout is omitted.

Although the specific explanation about the present invention is made above referring to the embodiments, the present invention is not limited thereto and is susceptible to various modifications and alternative forms.

Although the connector 100, 100A, 100B has the movable member 250, 250A, 250B, the present invention is not limited thereto. The connector of the present invention may be a connector which has no movable member 250, 250A, 250B and therefore requires an insertion force when the second connection object 700 is inserted into the connector.

In the connector 100, 100A, 100B of the present embodiment, only the contact portion 420, 420B is connected with the second connection portion 710 of the second connection object 700. However, the present invention is not limited thereto. The pressing portion 445, 445B may be *configured* to be connected with a connection portion which is formed on an upper surface of the second connection object 700.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector attachable to a first connection object in an up-down direction and connectable with a second connection object which is to be inserted rearward into the connector along a front-rear direction perpendicular to the up-down direction, the second connection object having a sheet-like or plate-like shape, wherein:

the first connection object has a plurality of first connection portions;

the second connection object has a plurality of second connection portions;

the connector comprises a plurality of terminals and a holding member;

the holding member has a holding portion and a sandwiched portion;

each of the terminals is held by the holding portion of the holding member;

the terminals are arranged in a pitch direction perpendicular to both the up-down direction and the front-rear direction;

each of the terminals has a connecting portion and a contact portion;

the connecting portions of the terminals are connected with the first connection portions, respectively, when the connector is attached to the first connection object;

the contact portions of the terminals are connected with the second connection portions, respectively, when the second connection object is inserted into the connector;

the connecting portion has a plate-like shape intersecting with the up-down direction;

a center of the contact portion and a center of the connecting portion are positioned at positions different from each other in the pitch direction;

the sandwiched portion and the connecting portion at least overlap with each other when the connector is viewed along the up-down direction;

one of the sandwiched portion and the connecting portion is visible when the connector is viewed along an upward direction of the up-down direction; and a remaining one of the sandwiched portion and the connecting portion is visible when the connector is viewed along a downward direction of the up-down direction.

2. The connector as recited in claim 1, wherein:

the holding member has an upper wall portion and a lower wall portion;

the upper wall portion and the lower wall portion are positioned away from each other in the up-down direction;

the connector is formed with a receiving portion between the upper wall portion and the lower wall portion in the up-down direction;

the receiving portion receives a part of the second connection object when the second connection object is connected with the connector;

the contact portion protrudes upward in the up-down direction beyond the lower wall portion; and the sandwiched portion is positioned upward of the connecting portion in the up-down direction.

3. The connector as recited in claim 1, wherein:

the connecting portion is positioned forward of the contact portion in the front-rear direction;

the upper wall portion has a front end in the front-rear direction;

the lower wall portion has a front end in the front-rear direction;

the front end of the upper wall portion is positioned rearward of the front end of the lower wall portion in the front-rear direction;

the sandwiched portion is formed as a part of the lower wall portion; and the sandwiched portion is visible when the connector is viewed along the downward direction of the up-down direction.

4. The connector as recited in claim 3, wherein:

at least in a predetermined region, the terminal has no portion protruding upward in the up-down direction beyond the lower wall portion;

the predetermined region is between the front end of the lower wall portion and a predetermined position of the sandwiched portion along the front-rear direction;

the connecting portion has a rear end in the front-rear direction; and the predetermined position of the sandwiched portion is positioned at a position same as a position of the rear end of the connecting portion in the front-rear direction.

5. The connector as recited in claim 4, wherein the contact portion is positioned rearward of the front end of the upper wall portion in the front-rear direction.

6. The connector as recited in claim 3, wherein:

a lower part of the holding member is formed with a receiving recess;

the receiving recess is recessed upward in the up-down direction and is opened rearward in the front-rear direction; and when the connector is attached to cables which function as the first connection object, the receiving recess receives a part of each of the cables.

7. The connector as recited in claim 1, wherein the sandwiched portion is distinct and separated from the holding portion.

8. The connector as recited in claim 1, wherein:

the terminal further has a lower-jaw portion, an upper-jaw portion, an intermediate portion and a coupling portion;

the contact portion protrudes upward in the up-down direction from the lower-jaw portion;

the lower-jaw portion and the upper-jaw portion are positioned away from each other in the up-down direction;

the intermediate portion connects the lower-jaw portion and the upper-jaw portion with each other;

the coupling portion couples a lower edge of the lower-jaw portion and the connecting portion with each other; and the lower edge of the lower-jaw portion and the connecting portion are positioned away from each other in the up-down direction.

9. The connector as recited in claim 8, wherein:

the holding member is formed with facing portions and recessed portions;

the terminals correspond to the facing portions and the recessed portions, respectively;

each of the facing portions faces each of the lower-jaw portion and the coupling portion of the corresponding terminal in the pitch direction; and each of the recessed portions is recessed beyond the corresponding facing portion in the pitch direction.

10. The connector as recited in claim 9, wherein each of the recessed portions is opened both forward and upward.

11. A cable harness comprising the connector as recited in claim 1 and cables, wherein:

the cables function as the first connection object; and the cables are connected with the connector.

* * * * *